US007205972B1

(12) United States Patent
Kyeong et al.

(10) Patent No.: US 7,205,972 B1
(45) Date of Patent: Apr. 17, 2007

(54) METHOD AND APPARATUS FOR DRIVING LIQUID CRYSTAL DISPLAY

(75) Inventors: Chang Su Kyeong, Daegu (KR); Seung Kuk Ahn, Kyoungsangbuk-do (KR)

(73) Assignee: LG. Philips LCD Co., Ltd., Seoul (KR)

( * ) Notice: Subject to any disclaimer, the term of this patent is extended or adjusted under 35 U.S.C. 154(b) by 523 days.

(21) Appl. No.: 10/717,638

(22) Filed: Nov. 21, 2003

(30) Foreign Application Priority Data

Dec. 16, 2002 (KR) ..... 10-2002-0080220

(51) Int. Cl.
*G09G 3/36* (2006.01)

(52) U.S. Cl. ..... 345/98; 345/100

(58) Field of Classification Search ..... 345/87–100
See application file for complete search history.

(56) References Cited

U.S. PATENT DOCUMENTS 6,229,512 B1 * 5/2001 Shigehiro ..... 345/98
6,597,349 B1 * 7/2003 Koyama et al. ..... 345/204

* cited by examiner

*Primary Examiner*—Alexander Eisen
(74) *Attorney, Agent, or Firm*—McKenna Long & Aldridge LLP

(57) ABSTRACT

A driving apparatus for a liquid crystal display includes a first multiplexor array to perform time-division on input pixel data to supply time-divided pixel data having a horizontal period divided into four ¼ periods; a digital-analog conversion array to convert the time-divided pixel data pixel voltage signals; and a demultiplexor array to drive data lines by performing time-division on the pixel voltage signal by the ¼ period.

28 Claims, 14 Drawing Sheets

METHOD AND APPARATUS FOR DRIVING LIQUID CRYSTAL DISPLAY

The present invention claims the benefit of Korean Patent Application No. 2002-80220 filed in Korea on Dec. 16, 2002, which is hereby incorporated by reference.

BACKGROUND OF THE INVENTION

1. Field of the Invention

The present invention relates to a method and an apparatus for driving a liquid crystal display, and more particularly, to a method and an apparatus for driving a liquid crystal display that reduces the number of data drive integrated circuits by supplying data to data lines on a time-division basis.

2. Description of the Related Art

In general, a liquid crystal display displays pictures by adjusting the light-transmittance of a liquid crystal using an electric field. For this purpose, the liquid crystal display comprises a liquid crystal display panel where liquid crystal cells are arranged in a active matrix form and a drive circuit for driving the liquid crystal cells of the liquid crystal display panel. In fact, the liquid crystal display, as shown in FIG. 1, comprises data drive integrated circuits 4 (ICs) connected to the liquid crystal display panel 2 through a data tape carrier packages 6 (TCPs), and gate drive integrated circuits 8 connected to the liquid crystal display panel 2 through gate TCPs 10. The liquid crystal display panel 2 comprises a thin film transistor formed at each intersection area of gate lines and data lines, and a liquid crystal cell connected to the thin film transistor. The gate lines are usually arranged horizontally while the data lines are arranged vertically. A gate electrode of the thin film transistor is connected to any one of gate lines, and a source electrode is connected to any one of data lines. The thin film transistor supplies a pixel voltage signal from the data line to the liquid crystal cell in response to a scan signal from the gate line. The liquid crystal cell comprises a pixel electrode connected to a drain electrode of the thin film transistor and a common electrode facing the pixel electrode with liquid crystal material therebetween. The liquid crystal cell adjusts the light transmittance by driving the liquid crystal in response to the pixel voltage signal supplied to the pixel electrode.

Each of the gate drive ICs 8 is mounted on each corresponding gate TCP 10. The gate drive ICs 8 mounted on corresponding gate TCPs 10 are electrically connected to respective gate pads of the liquid crystal display panel 2 through the gate TCPs 10. The gate drive ICs 8 sequentially drive the gate lines of the liquid crystal display panel 2 for each horizontal period (1H). Each of the data drive ICs 4 is mounted on each corresponding data TCP 6. The data drive ICs 4 mounted on respective data TCPs 6 are electrically connected to corresponding data pads of the liquid crystal display panel 2 through the data TCP 6. The data drive IC 4 converts digital pixel data into an analog pixel voltage signal and supplies the pixel voltage signal to the data lines of the liquid crystal display panel 2 for each horizontal period (1H).

To this end, each of the data drive ICs 4, as shown in FIG. 2, comprises a shift register array 12 sequentially supplying a sampling signal, first and second latch arrays 16 and 18 providing a pixel data in response to the sampling signal to output the latched data, a first multiplexor 15 (MUX) array arranged between the first and the second latch arrays 16 and 18, a digital to analog converter (DAC) array 20 converting the pixel data from the second latch array 18 into the pixel voltage signal, a buffer array 26 buffering the pixel voltage signal from the DAC array 20 to output the buffered signal, and a second MUX array 30 selecting a proceeding path of the output of the buffer array 26. The data drive IC 4 further comprises a data register 34 relaying pixel data (R, G, B) supplied from a timing controller (not shown), and a gamma voltage part 36 supplying a positive and a negative gamma voltage necessary to the DAC array 20. Each of the data drive ICs 4 having such components has n channels of data output (for example, 384 or 480 channels) to drive n data lines. FIG. 2 illustrates only 6 channels (DL1 to DL6) of n channels of such a data drive IC 4.

The data register 34 relays the pixel data from the timing controller and supplies the relayed data to the first latch array 16. Herein, the timing controller divides the pixel data into even-numbered pixel data (RGBeven) and odd-numbered pixel data (RGBodd) to supply the divided pixel data to the data register 34 through each transmission line with decreased transmission frequency. The data register 34 outputs the even-numbered pixel data (RGBeven) and the odd-numbered pixel data (RGBodd) input to the first latch array 16 through each transmission line. Herein, each of the even-numbered pixel data (RGBeven) and the odd-numbered pixel data (RGBodd) includes red (R), green (G), and blue (B) pixel data. The gamma voltage part 36 subdivides a plurality of gamma reference voltage input from gamma reference voltage generation part (not shown) by gray levels and outputs the gamma reference voltage.

The shift register array 12 generates sequential sampling signals and supplies the generated signals to the first latch array 16. The shift register array 12 includes the shift registers 14 of n/6 numbers. The first stage of the shift register 14 shown in FIG. 2 shifts a source start pulse (SSP) input from the timing controller according to a source sampling clock signal (SSC) and outputs the shifted source start pulse as the sampling signal and, at the same time, provides the shifted source start pulse to the next stage of the shift register 14 as a carry signal (CAR). The source start pulse (SSP), as shown in FIGS. 3A and 3B, is supplied for each horizontal period (1H) and shifted for each source sampling clock signal (SSC) to be output as the sampling signal.

The first latch array 16 samples the pixel data (RGBeven, RGBodd) from the data register 34 by designated units in response to the sampling signal from the shift register array 12 to latch the sampled pixel data. The first latch array 16 comprises the first latches 13 of the n numbers to latch the pixel data (R, G, B) of n numbers and each of the first latch 13 has the size corresponding to the bit number (for example 3 bit or 6 bit) of the pixel data (R, G, B). The first latch array 16 samples the even-numbered pixel data (RGBeven) and the odd-numbered pixel data (RGBodd), i.e., the pixel data of 6 numbers, for each sampling signal, latches the sampled data and then outputs the latched data at the same time.

The first MUX array 15 determines the proceeding path of the pixel data (R, G, B) provided from the first latch array 16 in response to a polarity control signal (POL) from a timing controller. For this purpose, the first MUX array 15 comprises n+1 number of the first MUXs. Each of the first MUXs 17 receives the output of two adjacent first latches 13 to be selectively output accordance with the polarity control signal (POL). Herein, the output of each of the first latches 13 except first and last ones of the first latches 13 is commonly input to two adjacent first MUXs 17. The output of the first and last ones of the first latches 13 is commonly input to the second latch array 18 and the first MUX 17. The first MUX array 15 controls the pixel data (R, G, B) from each of the first latches 13 to proceed intact to the second latch part 18, or to proceed to the second latch part 18 after being shifted to the right by one in accordance with the polarity control signal (POL). As shown in FIGS. 3A and 3B, the polarity of the polarity control signal (POL) is inverted for each horizontal period (1H). As a result, the first MUX array 15 controls the polarity of the pixel data (R, G, B) by having each of the pixel data (R, G, B) from the first latch array 16 to output to a positive DAC (P DAC) 24 or a negative DAC (N DAC) 22 of the DAC array 20 through the second latch array 18 in response to the polarity control signal (POL).

The second latch array 18 simultaneously latches and outputs the pixel data (R, G, B) input from the first latch array 16 through the first MUX array 15 in response to a source output enable signal (SOE) from the timing controller. Particularly, the second latch array 18 comprises the second latches 19 of the n+1 numbers in consideration when the pixel data (R, G, B) from the first latch array 16 is shifted to the right to be input. The source output enable signal (SOE), as shown in FIGS. 3A and 3B, is generated for each horizontal period (1H). The second latch array 18 latches the pixel data (R, G, B) input at the rising edge of the source output enable signal (SOE) at the same time and outputs the latched data at the falling edge at the same time.

The DAC array 20 converts the pixel data (R, G, B) from the second latch array 18 into the pixel voltage signal using the positive and the negative gamma voltage (GH,GL) from the gamma voltage part 36 and outputs them. For this purpose, DAC array 20 comprises PDAC 24 and NDAC 22 of n+1 numbers. The PDAC 24 and NDAC 22 are arranged alternatively and in parallel to be driven by the dot inversion system. The PDAC 24 converts the pixel data (R, G, B) from the second latch array 18 into positive pixel voltage signal using a positive gamma voltage signal GH. The NDAC 22 converts the pixel data (R, G, B) from the second latch array 18 into negative pixel voltage signal using a negative gamma voltage signal.

Each of the n+1 number of buffers 28 included in the buffer array 26 buffers the pixel voltage signal output from each PDAC 24 and NDAC 22 of the DAC array 20 and outputs them. The second MUX array 30 determines the proceeding path of the pixel voltage signal supplied from buffer array 26 in response to the polarity control signal (POL) from the timing controller. For this purpose, the second MUX array 30 comprises the second MUXs 32 of the n numbers. Each of the second MUXs 32 responds to the polarity control signal (POL) to select the output of any one among two adjacent buffers 28, thereby outputting them to corresponding data line (DL). Herein, the output stage of the buffers 28 except the first and last buffers 28 are held in common by and supply the output to two adjacent second MUXs 32. The second MUX array 30 having such a configuration causes the pixel voltage signal from each of the buffers 28 except the last buffer 28 to correspond intact one-to-one with the data line (DL1 to DL6) in response to the polarity control signal (POL). Further the second MUX array 30 causes the pixel voltage signal from each of the buffers 28 except the first buffer 28 to be shifted to the left by one to correspond one-to-one with the data line (DL1 to DL6) in response to the polarity control signal (POL).

With respect to the polarity control signal (POL), identically with what is supplied to the first MUX array 15, as shown in FIGS. 3A and 3B, its polarity is inverted for each horizontal period (1H). Like this, the second MUX array 30 together with the first MUX array 15 determines the polarity of the pixel voltage signal supplied to the data lines (DL1 to DL6) in response to the polarity control signal. The pixel voltage signal supplied to each data line D1 to D6 through the second MUX array 30 has the polarity contrary to adjacent pixel voltage signals. In other words, as shown in FIGS. 3A and 3B, the pixel voltage signal output to the odd-numbered data lines (DLodd) such as DL1, DL3, DL5, and so on, and the pixel voltage signal output to the even-numbered data lines (DLeven) such as DL2, DL4, DL6, and so on have contrary polarity each other. Also, the polarity of the odd-numbered data line (DLodd) and the even-numbered data line (DLeven) is inverted for each horizontal period (1H) when the gate lines (GL1, GL2, GL3, . . . ) are sequentially driven, and in addition, is inverted for each frame.

However, each of the related art data drive ICs 4 should include the DACs and the buffers of n+1 numbers to drive the data lines of n numbers. As a result, the related art data drive ICs 4 have a disadvantage in that their configuration is complicated and their fabrication cost is relatively high.

SUMMARY OF THE INVENTION

Accordingly, the present invention is directed to a method and apparatus for driving a liquid crystal display that substantially obviates one or more of the problems due to limitations and disadvantages of the related art.

An object of the present invention is to provide a liquid crystal display with a decreased number of data drive integrated circuits.

Another object of the present invention is to provide a liquid crystal display that compensates for a difference between the charged amounts of pixel voltages due to a time difference in charging pixel voltage when driving data lines on a time-division basis.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a driving apparatus for a liquid crystal display includes a first multiplexor array to perform time-division on input pixel data to supply time-divided pixel data having a horizontal period divided into four ¼ periods; a digital-analog conversion array to convert the time-divided pixel data pixel voltage signals; and a demultiplexor array to drive data lines by performing time-division on the pixel voltage signal by the ¼ period.

In another aspect, a driving method of a liquid crystal display comprises the steps of performing time-division on input pixel data to supply time-divided pixel data having a horizontal period divided into four ¼ periods; converting the time-divided pixel data into pixel voltage signals; and performing time-division on the pixel voltage signal to supply the time-divided pixel voltage signal to data lines of the liquid crystal display by the ¼ period.

In another aspect, a liquid crystal display comprises a liquid crystal panel; and a driving apparatus connected to the liquid crystal panel, the driving apparatus includes a first multiplexor array to perform time-division on input pixel data to supply time-divided pixel data having a horizontal period divided into four ¼ periods, a digital-analog conversion array to convert the time-divided pixel data pixel voltage signals, and a demultiplexor array to drive data lines by performing time-division on the pixel voltage signal by the ¼ period.

In another aspect, a driving apparatus for a liquid crystal display comprises means for performing time-division on input pixel data to supply time-divided pixel data having a horizontal period divided into four ¼ periods; means for converting the time-divided pixel data into pixel voltage signals; and means for performing time-division on the pixel voltage signal to supply the time-divided pixel voltage signal to data lines of the liquid crystal display by the ¼ period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
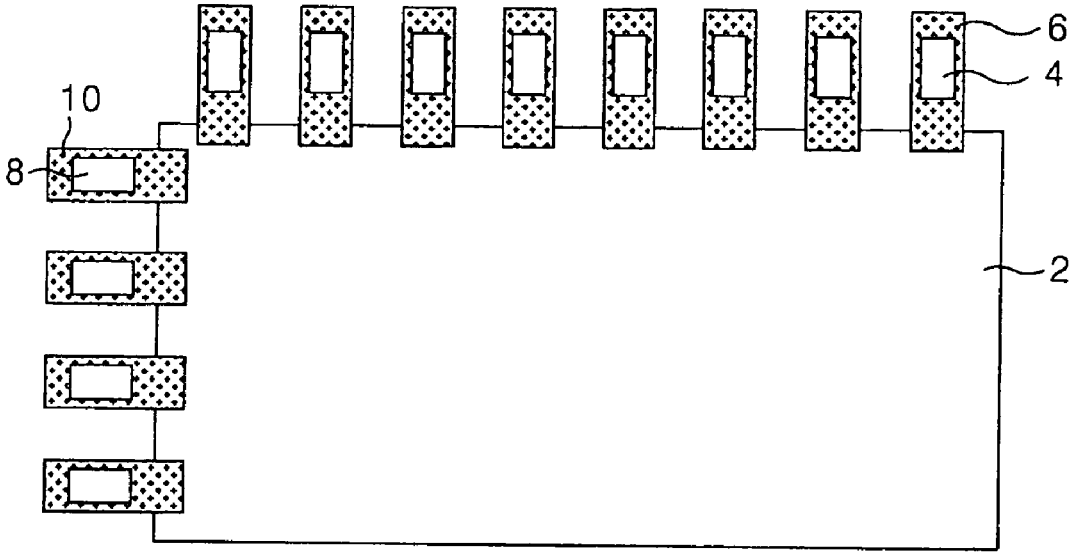
FIG. 1 RELATED ART
FIG. 1 is a schematic diagram illustrating a configuration of a related art liquid crystal display.
Figure 2:
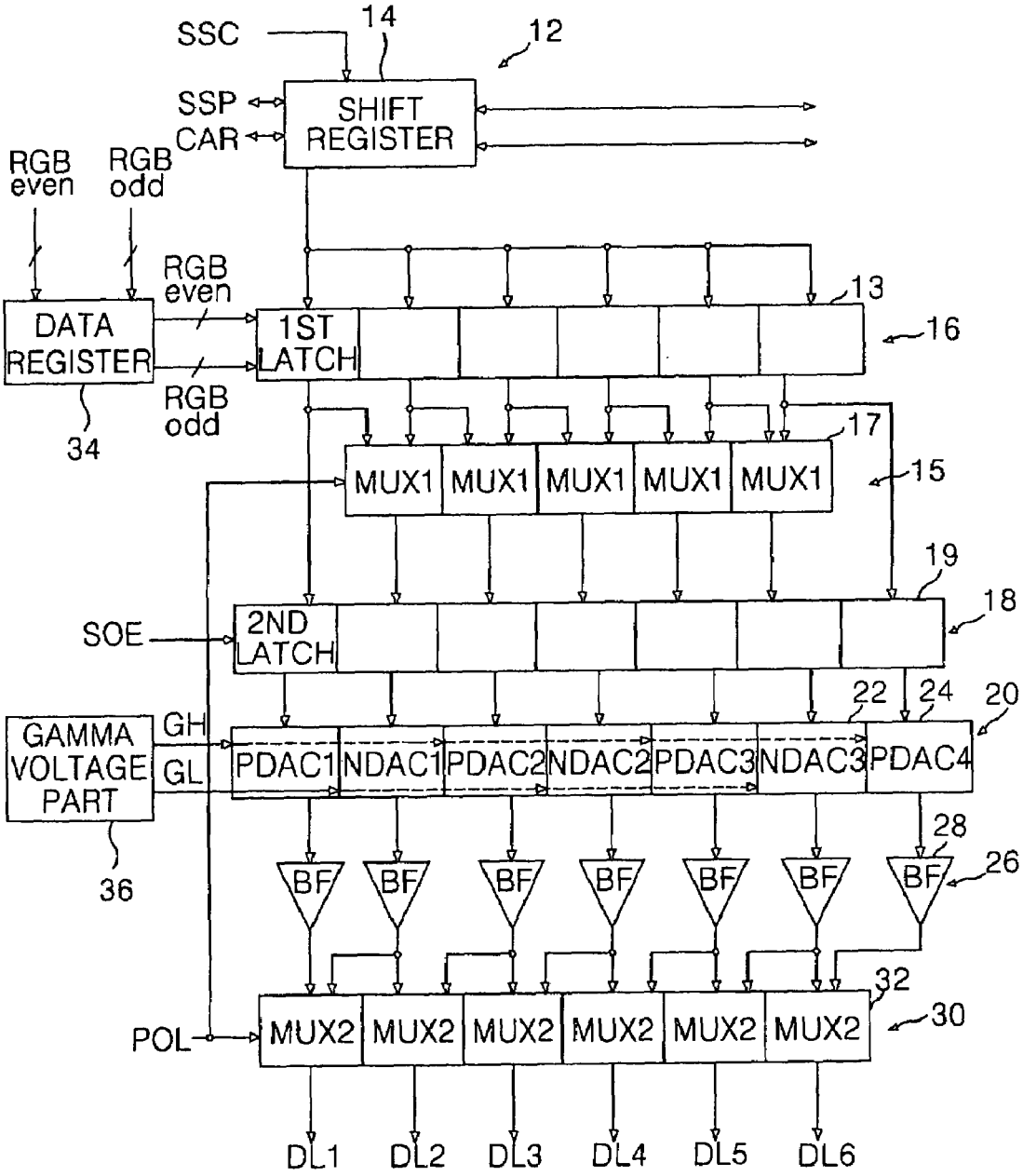
FIG.2 RELATED ART
FIG. 2 is a block diagram illustrating a detail configuration of the related art data drive IC shown in FIG. 1.
Figure 3A:
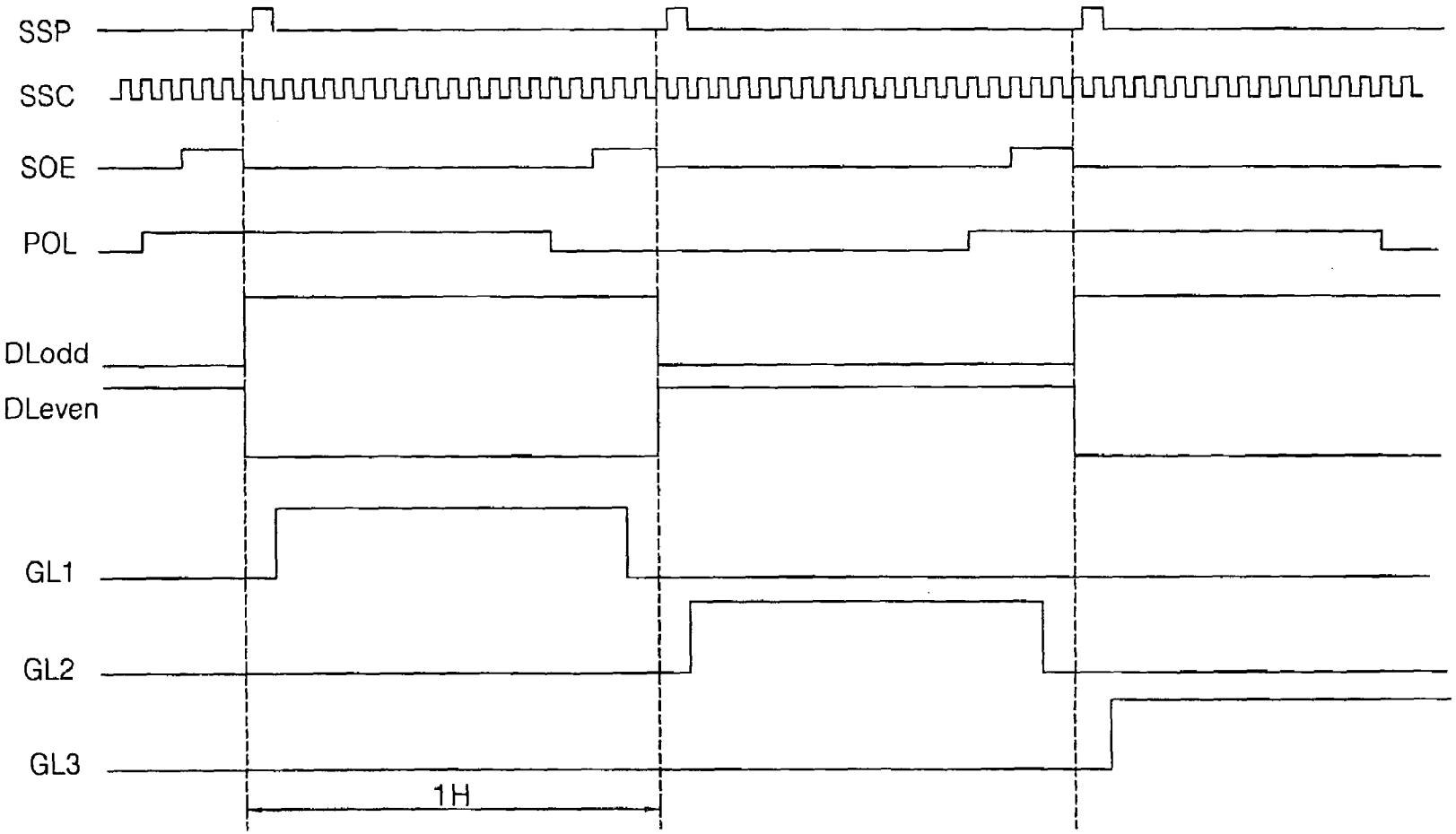
FIG. 3A RELATED ART
FIGS. 3A and 3B are waveform diagrams illustrating odd-numbered and even-numbered frame drive waveforms of the related art data drive IC shown in FIG. 2.
Figure 3B:
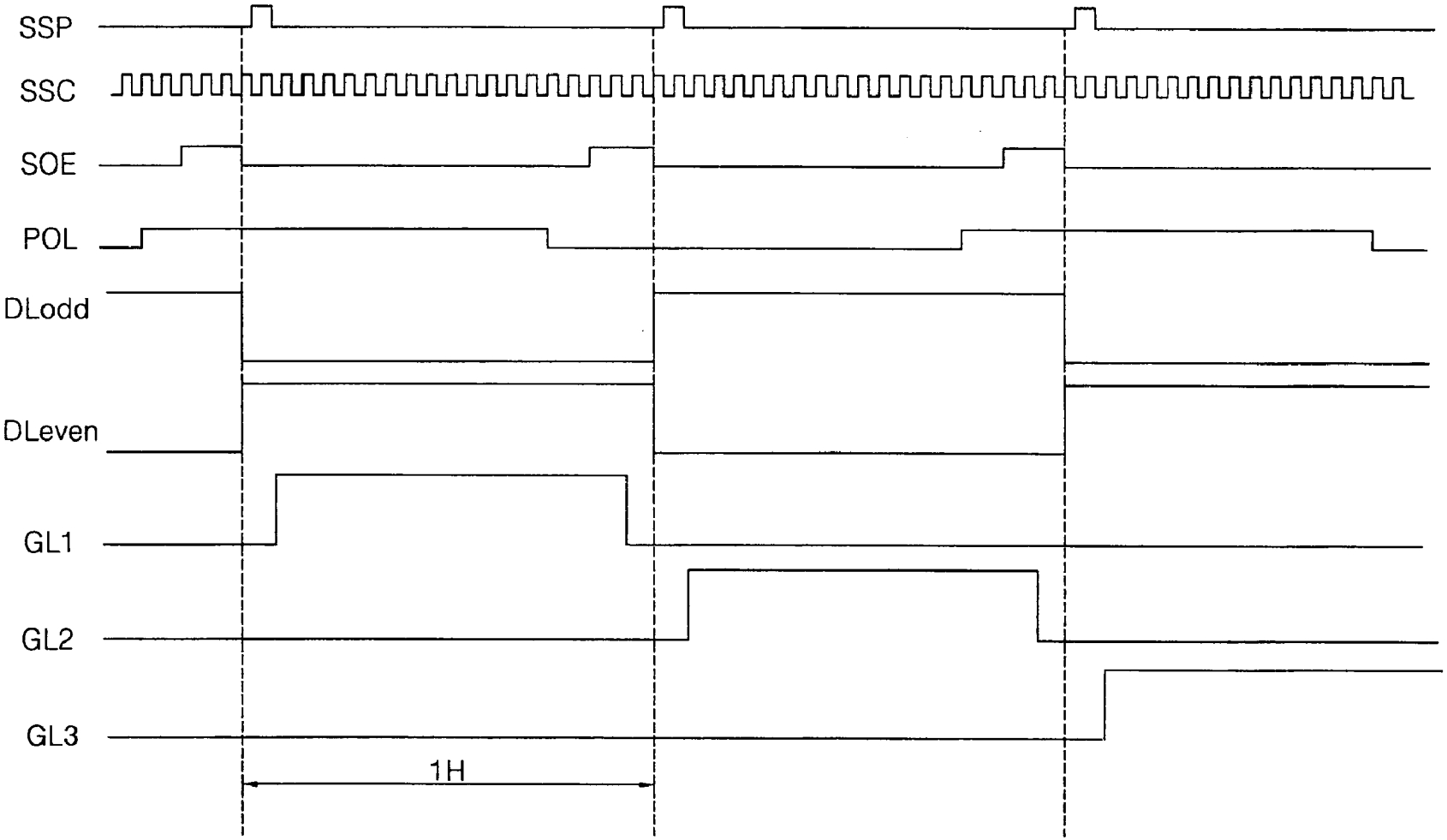
FIG.3B RELATED ART
Figure 4:
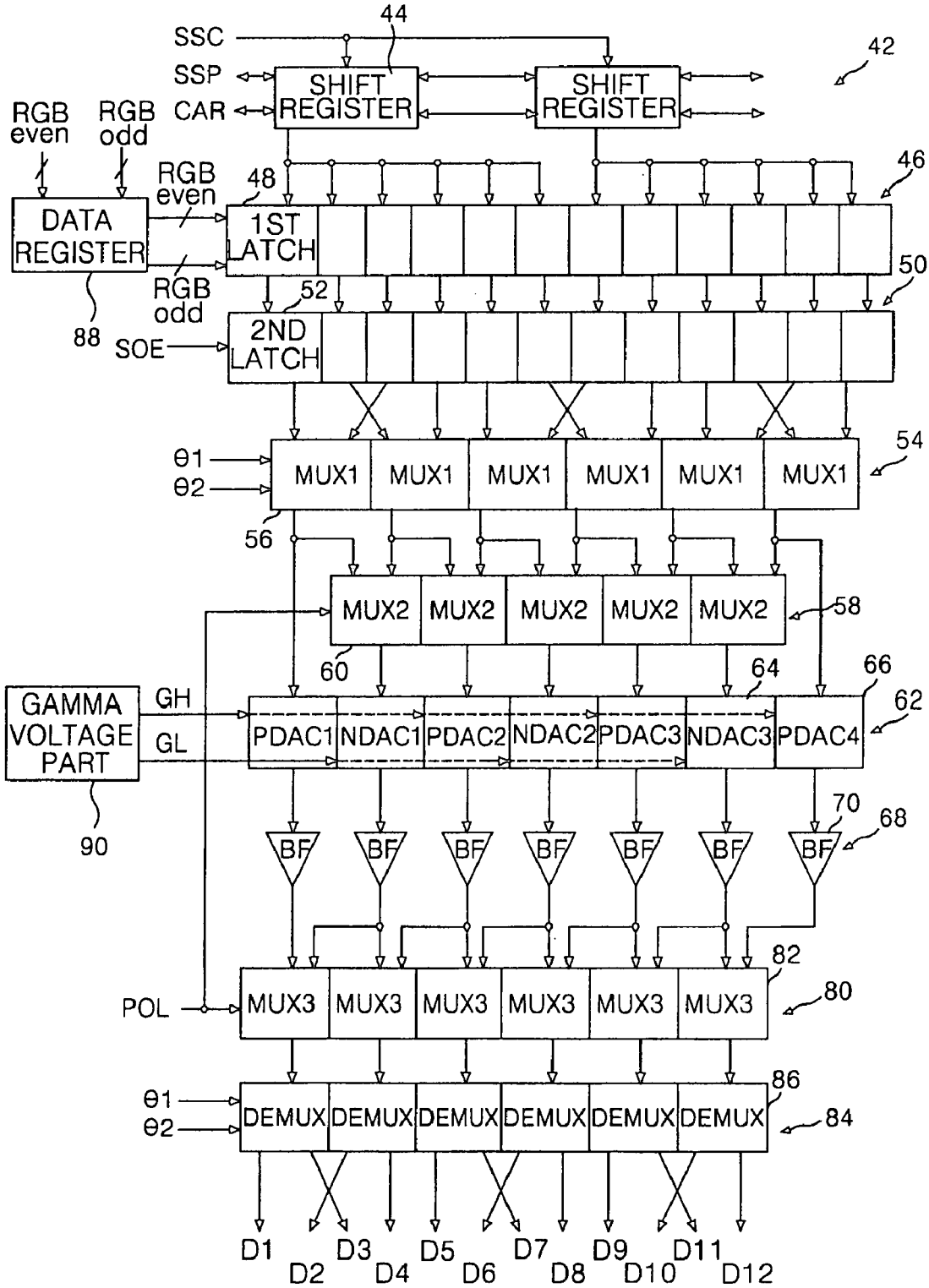
FIG. 4 is a block diagram illustrating a configuration of a data drive IC according to an embodiment of the present invention.
Figure 5A:
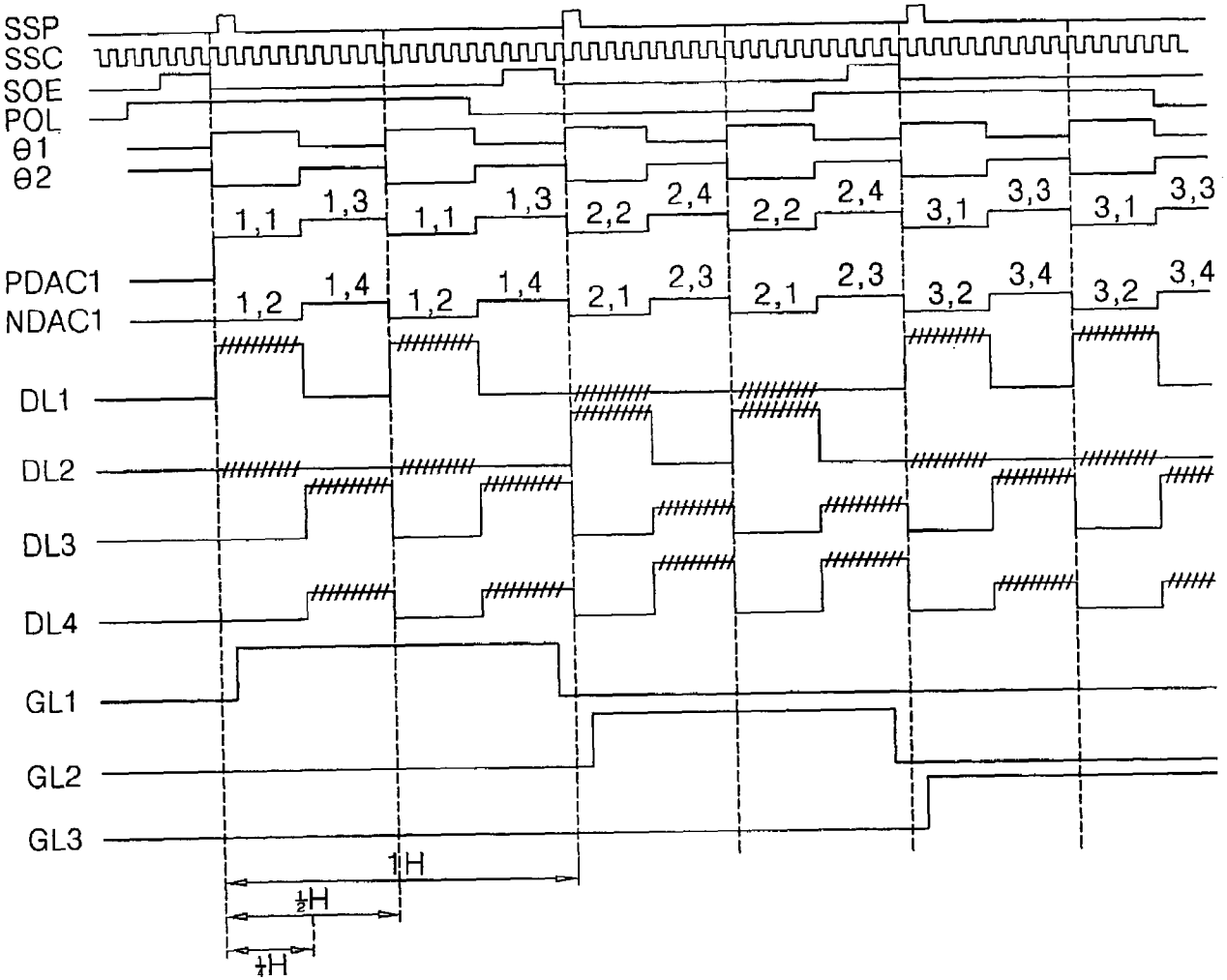
FIGS. 5A and 5B are waveform diagrams illustrating odd-numbered and even-numbered frame drive waveforms of the data drive IC shown in FIG. 4.
Figure 5B:
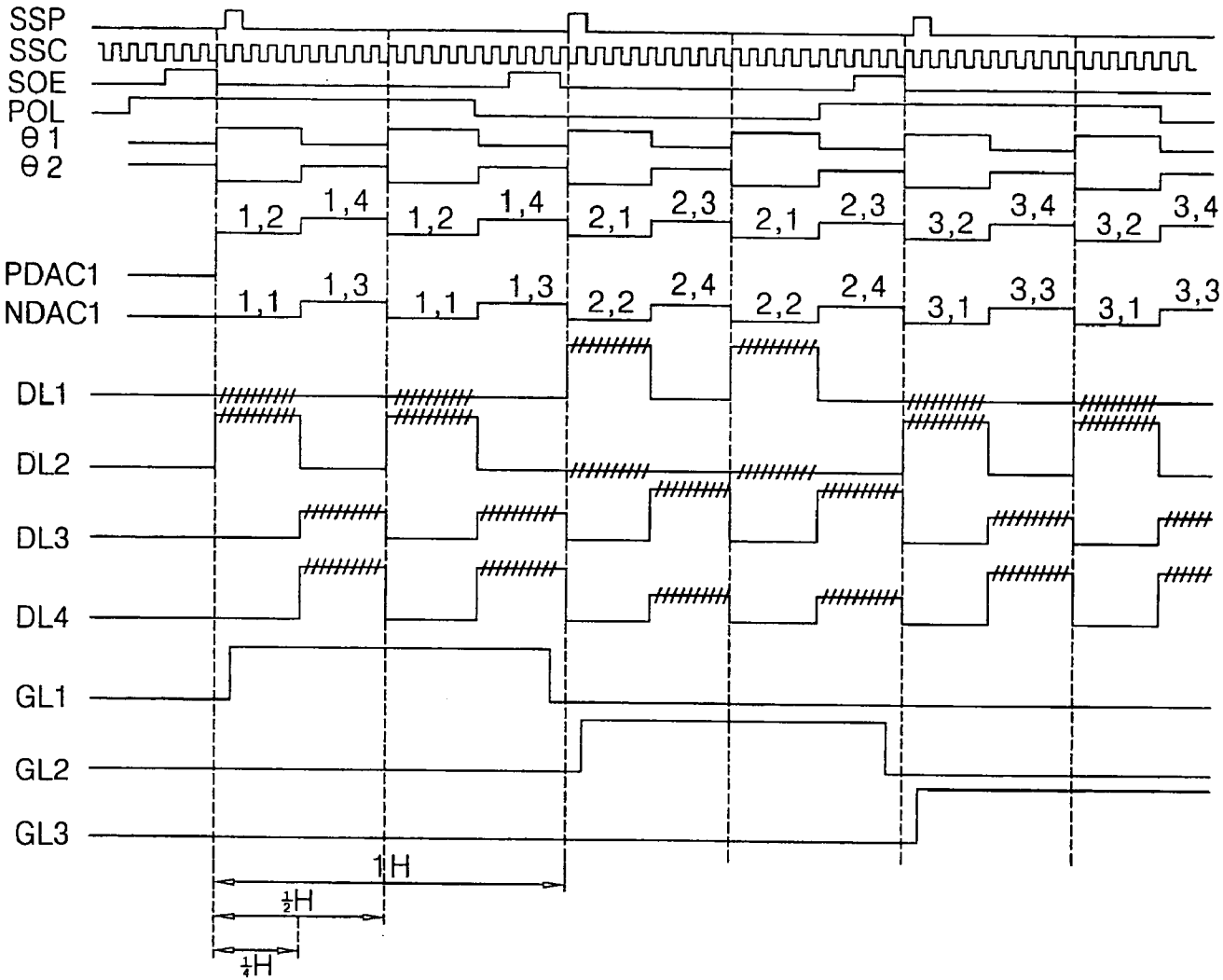

FIG. 4 is a block diagram illustrating a configuration of a data drive IC of a liquid crystal display according to an embodiment of a present invention. FIGS. 5A and 5B are waveform diagrams illustrating odd-numbered frame and even-numbered frame drive waveforms of the data drive IC shown in FIG. 4.

The data drive IC, as shown in FIG. 4, comprises a shift register array 42 supplying sequential sampling signals, a first and a second latch arrays 46 and 50 latching pixel data (R, G, B) in response to a sampling signal to output the latched data, a first MUX array 54 performing time-division on the pixel data (R, G, B) from the second latch array 50 to output the time-divided data, a second MUX array 58 controlling a proceeding path of the pixel data (R, G, B) supplied from the first MUX array 54, a DAC array converting the pixel data (R, G, B) from the second MUX array 58 into a pixel voltage signal, a buffer array 68 buffering the pixel voltage signal from the DAC array 62 to output the buffered signal, a third MUX array 80 controlling a proceeding path of the output of the buffer array 68, and a DEMUX array 84 performing time-division on the pixel voltage signal from the third MUX array 80 to output the time-divided signal to data lines (DL1 to DL12). The data drive IC as shown in FIG. 4 further comprise a data register 88 relaying the pixel data (R, G, B) supplied from a timing controller (not shown) and a gamma voltage part 90 supplying a positive and a negative gamma voltage necessary for the DAC array 62.

The data drive IC having such a configuration drives the data lines of 2n numbers twice as much as that of the related art in use of DAC 64, 66 and buffer 70 of n+1 numbers by driving the DAC array 62 using the first MUX array 54 and the DEMUX array 84. The data drive IC has data outputs of 2n channels to drive the data lines of 2n numbers, but FIG. 4 illustrates only 12 channels (DL1 to DL12) assuming that n=6.

The data register 88 relays the pixel data from the timing controller and supplies the relayed data to the first latch array 46. In particular, the timing controller divides the pixel data into even-numbered pixel data (RGBeven) and odd-numbered pixel data (RGBodd) for decreased transmission frequency and supplies them to the data register 88 through each transmission line. The data register 88 outputs the input even-numbered pixel data (RGBeven) and odd-numbered pixel data (RGBodd) to the first latch array 46 through each transmission line. Herein, each of the even-numbered pixel data (RGBeven) and odd-numbered pixel data (RGBodd) includes red (R), green (G), and blue (B) pixel data. The gamma voltage part 90 subdivides a plurality of gamma reference voltage input from gamma reference voltage generator (not shown) by gray levels and outputs them.

The shift register array 42 generates sequential sampling signals which are supplied to the first latch array 46. To this end, the shift register array 42 comprises the shift register 44 of 2n/6 numbers (here n=6). The first stage of the shift register 44, as shown in FIG. 4, shifts a source start pulse (SSP) input from the timing controller in accordance with a source sampling clock signal (SSC) and outputs it as sampling signal, and at the same time, supplies it as a carry signal (CAR) to the next stage of the shift register 44. The source start pulse (SSP), as shown in FIGS. 5A and 5B, is supplied for each horizontal period and is shifted for each source sampling clock signal (SSC) and is output as a sampling signal.

The first latch array 46 samples the pixel data (RGBeven, RGBodd) from the data register 88 by designated units in response to the sampling signal from the shift register array 42 and latches the sampled pixel data. The first latch array 46 comprises the first latches of 2n numbers in order to latch the pixel data (R, G, B) of 2n numbers (here n=6). Each of the first latches 48 has a size corresponding to the bit number (3 bit or 6 bit) of the pixel data (R, G, B). The first latch array 46 samples the even-numbered pixel data (RGBeven) and the odd-numbered pixel data (RGBodd), i.e., the pixel data of 6 numbers, for each sampling signal and then outputs them at the same time.

The second latch array 50 latches the pixel data (R, G, B) from the first latch array 46 at the same time in response to the source output enable (SOE) from the timing controller and then outputs them. The second latch array 50 comprises the second latches 52 of 2n numbers (here n=6) in the same way as the first latch array 46. The source output enable (SOE), as shown in FIGS. 5A and 5B, is generated for each horizontal period.

The first MUX array 54 performs time-division on the pixel data of 2n numbers (here n=6) from the second latch array 50 by N numbers for each H/4 period in response to the first and second selection control signal (T1,T2) from the timing controller and outputs the time-divided pixel data. For this purpose, the first MUX array 54 comprises the first MUXs of n numbers. Each of the first MUXs 56 selects an output of any one between two of the second latches 52 in the second latch array 50 and outputs the selected one. In other words, each of the first MUXs 56 performs time-division on the output of two of the second latches 52 for each ¼ horizontal period.

Explaining this in detail, for driving by the dot inversion system, the odd-numbered first MUX 56 selects any one among outputs of the two odd-numbered second latches in response to the first selection control signal (T1) to output the selected one, and the even-numbered first MUX 56 selects any one among outputs of the two even-numbered second latches 52 in response to the second selection control signal (T2) to output the selected one. Herein, the first selection control signal (T1) has a period of ½ horizontal interval. Further, the second selection control signal (T2) has a period of ½ horizontal interval and, in addition, is supplied to have a polarity different from the first selection control signal (T1). Accordingly, one horizontal period is divided by ¼ period for driving.

For example, the first MUX 56 of the first order selects the first pixel data from the second latch 52 in the first ¼ horizontal period (0–¼) and the third ¼ horizontal period (2/4–3/4) among one horizontal period to output the selected data, and selects the third pixel data in the second ¼ horizontal period (¼–2/4) and the fourth ¼ horizontal period (3/4–4/4) to output the selected data in response to the first selection control signal (T1). The first MUX 56 of the second order selects the second pixel data in the first ¼ horizontal period (0–¼) and the third ¼ horizontal period (2/4–3/4) to output the selected data, and selects the fourth pixel data in the second ¼ horizontal period (¼–2/4) and the fourth ¼ horizontal period (3/4–4/4) to output the selected data in response to the second selection control signal (T2).

The second MUX array 58 responds to the polarity control signal (POL) to determine the proceeding path of the pixel data (R, G, B) supplied from the first MUX array 54. For this purpose, the second MUX array 58 comprises the second MUXs 60 of n−1 numbers. Each of the second MUXs 60 receives the output of the two adjacent first MUXs 56 and outputs them selectively in accordance with the polarity control signal (POL). Herein, the output of each of the first MUXs 56 except the first MUXs 56 of the first and the last order is commonly input to the two adjacent second MUXs 60. The output of the first MUXs 56 of the first and the last order is commonly input to the PDAC 66 and the second MUX 60. The second MUX array 58 having such a configuration controls the pixel data (R, G, B) from each of the first MUXs to proceed intact to the DAC array 62, or to proceed to the DAC array 62 after being shifted to the right line by line in accordance with the polarity control signal (POL). For drive by the dot inversion system, the polarity of the polarity control signal (POL) is inverted for each horizontal period, as shown in FIGS. 5A and 5B. In the end, the second MUX array 58 causes each of the pixel data (R, G, B) from the first MUX array 54 to be output to the PDAC 64 or the NDAC 66 disposed alternately in the DAC array 62 in response to the polarity control signal (POL), thereby controlling the polarity of the pixel data (R, G, B).

For example, in the first horizontal period, the first and the third pixel data sequentially output from the first MUX 56 of the first order are supplied to the PDAC1 66 directly without passing through the second MUX 60, and the second and the fourth pixel data sequentially output from the first MUX 56 of the second order are supplied to NDAC1 64 by the second MUX 60 of the first order. Also, in the second horizontal period, the first and the third pixel data are supplied to the NDAC1 64 by the second MUX 60 of the first order, and the second and the fourth pixel data are supplied to PDAC2 66 by the second MUX 60 of the second order.

The DAC array 62 converts the pixel data (R, G, B) from the second MUX array 58 into the pixel voltage signal using the positive and the negative gamma voltage (GH,GL) from the gamma voltage part 90 to output the converted pixel data. For this purpose, the DAC array 62 comprises the PDAC 66 and the NDAC 64 of n+1 numbers. Also, for drive by the dot inversion system, the PDAC 66 and the NDAC 64 is disposed alternately and in parallel. The PDAC 66 converts the pixel data (R, G, B) from the second MUX array 58 into positive pixel voltage signal by use of positive gamma voltage (GH). The NDAC 64 converts the pixel data (R, G, B) from the second MUX array 58 into negative pixel voltage signal by use of negative gamma voltage (GL). Such PDAC 66 and NDAC 64 convert the digital pixel data input for each ¼ horizontal period into the analog pixel voltage signal.

For example, PDAC1 66, as shown in FIG. 5A, converts the odd-numbered pixel data [1,1] and [1,3] time-divided and input in the first horizontal period into the pixel voltage signal to output the pixel voltage signal. At the same time, NDAC2 64, as shown in FIG. 5A, converts the even-numbered pixel data [1,2] and [1,4] time-divided and input in the first horizontal period into the pixel voltage signal to output the pixel voltage signal. And then, NDAC2 64 converts the odd-numbered pixel data [2,1] and [2,3] time-divided and input in the second horizontal period into the pixel voltage signal to output the converted pixel voltage signal. At the same time, PDAC2 66 converts the even-numbered pixel data [2,2] and [2,4] time-divided and input in the second horizontal period into the pixel voltage signal to output the converted pixel voltage signal. The DAC array 62 performs time-division on the pixel data of 2n numbers by N numbers for each ¼ horizontal period, converts the time-divided pixel data into the pixel voltage signal, and outputs the pixel voltage signal.

Each of the buffers of n+1 numbers included in the buffer array 68 buffers the pixel voltage signal output from each of the PDAC 66 and NDAC 64 of the DAC array 62 and outputs the buffered signal.

The third MUX 80 determines the proceeding path of the pixel voltage signal supplied from the buffer array 68 in response to the polarity control signal (POL) from the timing controller. For this purpose, the third MUX array 80 comprises the third MUXs 82 of n numbers (here n=6). Each of the third MUXs 82 selects the output of any one among two adjacent buffers 70 to output the selected one in response to the polarity control signal (POL). Herein, the output stage of the buffers 70 except the first and the last buffer 70 is commonly input to the two adjacent third MUXs 82. The third MUX array 82 having such a configuration causes the pixel voltage signal from each of the buffers 70 except the last buffer 70 to correspond one to one with the DEMUXs 86, thereby being output intact, in response to the polarity control signal (POL). Further, the third MUX array 82 causes the pixel voltage signal from each of the buffers 70 except the first buffer 70 to correspond one to one with the DEMUXs 86, thereby being output, in response to the polarity control signal (POL). The polarity of the polarity control signal (POL), as shown in FIGS. 5A and 5B, is inverted for each horizontal period in the same way as it is supplied to the second MUX array 58 for drive by the dot inversion system. The third MUX array 80 like this determines the polarity of the pixel voltage signal together with the second MUX array 58 in response to the polarity control signal (POL). As a result, the pixel voltage signal output from the third MUX array 80 has the polarity contrary to adjacent pixel voltage signals and its polarity is inverted for each horizontal period.

The DEMUX array 84 selectively supplies the pixel voltage signal from the third MUX array 80 to the data lines of 2n numbers (here n=6) in response to the first and the second selection control signal (T1, T2) from the timing control signal. Accordingly, the DEMUX array 84 comprises the DEMUXs 86 of n numbers. Each of the DEMUX performs time-division on the pixel voltage signal supplied from each of the third MUX 82 and supplies the time divided signal to the two data lines. Specifically, the odd-numbered DEMUX 86 performs time-division on the output of the odd-numbered third MUX 82 to supply the time-divided output to the two odd-numbered data lines in response to the first selection control signal (T1) The even-numbered DEMUX 86 performs time-division on the output of the two even-numbered third MUX 82 to supply the time-divided output to the two even-numbered data lines in response to the second selection control signal (T2). The first and the second selection control signals (T1,T2), as shown in FIGS. 5A and 5B, have the period of the ¼ horizontal period in the same way as it is supplied to the first MUX array 54 and, in addition, have the polarity contrary to each other.

For example, the DEMUX 86 of the first order, as shown in FIGS. 5A and 5B, selectively supplies the output of the third MUX 82 of the first order for each ¼ horizontal period to the first and the third data line in response to the first selection control signal (T1). The DEMUX 86 of the second order also, as shown in FIGS. 5A and 5B, selectively supplies the output of the third MUX 82 of the first order for each ¼ horizontal period to the second and the fourth data line in response to the second selection control signal (T2).

More specifically, in response to the first selection control signal (T1), the DEMUX 86 of the first order supplies the pixel voltage signal [1,1] to the first data line (DL1) during the first ¼ horizontal period (0–¼) and the second ¼ horizontal period (2/4–3/4) among the first horizontal period in which the first gate line (GL1) is activated, and supplies the pixel voltage signal [1,3] to the third data line (DL3) during the second ¼ horizontal period (¼–2/4) and the fourth ¼ horizontal period (3/4–4/4). At the same time, in response to the second selection control signal (T2), the DEMUX 86 of the second order supplies the pixel voltage signal [1,2] to the second data line (DL2) during the first ¼ horizontal period (0–¼) and the third ¼ horizontal period (2/4–3/4) among the first horizontal period, and supplies the pixel voltage signal [1,4] to the fourth data line (DL4) during the second ¼ horizontal period (¼–2/4) and the fourth ¼ horizontal period (3/4–4/4).

Further, the DEMUX 86 of the first order supplies the pixel voltage signal [2,1], [3,1] to the first data line (DL1) during the first ¼ horizontal period (0–¼) and the third ¼ horizontal period (2/4–3/4) among the second horizontal period (H2) and the third horizontal period (H3), and supplies the pixel voltage signal [2,3],[3,3] to the third data line (DL3) during the second ¼ horizontal period (¼–2/4) and the fourth ¼ horizontal period (3/4–4/4). The DEMUX 86 of the second order supplies the pixel voltage signal [2,2], [3,2] to the first data line (DL1) during the first ¼ horizontal period (0–¼) and the third ¼ horizontal period (2/4–3/4) among the second horizontal period (H2) and the third horizontal period (H3), and supplies the pixel voltage signal [2,4],[3,4] to the third data line (DL3) during the second ¼ horizontal period (¼–2/4) and the fourth ¼ horizontal period (3/4–4/4).

By the data drive IC having such a configuration, the pixel voltage signal output to the odd-numbered data lines such as DL1,DL2, and so on, and the pixel voltage signal output to the even-numbered data lines such as DL2,DL4, and so on, as shown in FIGS. 5A and 5B, have a polarity contrary to each other. Also, the polarity of the odd-numbered data lines (DL1, DL3, . . . ) and the even-numbered data lines (DL2, DL4, . . . ) is inverted for each horizontal period (1H) and, in addition, inverted for each frame. That is, with respect to the present invention, the one horizontal period is divided into four, and the pixel voltage signal is supplied in the first and the third ¼ period or the pixel voltage signal is supplied in the second and the fourth ¼ period. Like this, if one horizontal period is divided into four and the pixel voltage signal is supplied during the odd-numbered ¼ period or the even-numbered ¼ period, the uniform pixel voltage can be charged to the liquid crystal cells.

Figure 6:
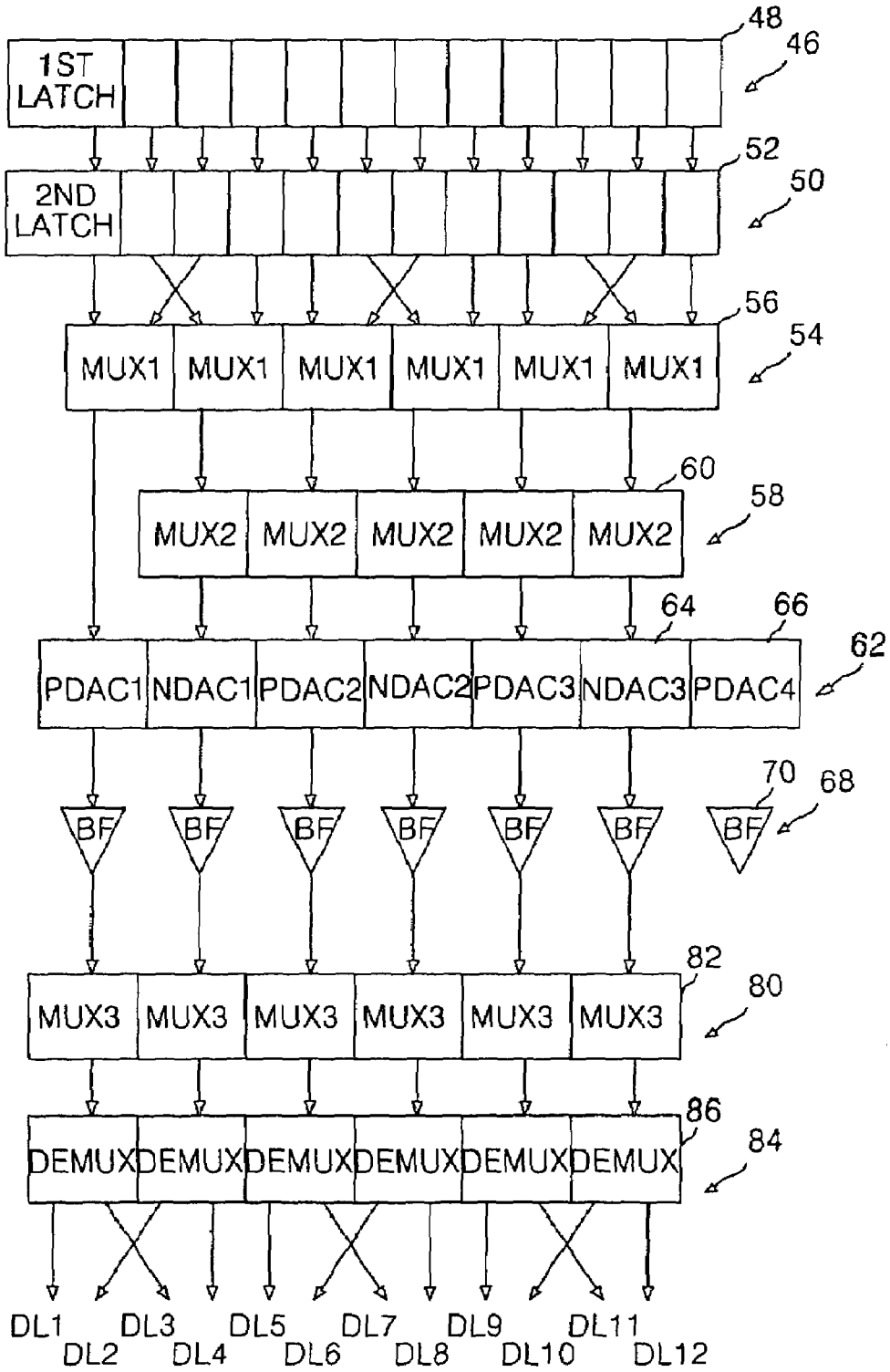
FIG. 6 is a flow chart representing a data flow within the data drive IC shown in FIG. 4 when a polarity control signal is in a low state.
Figure 7:
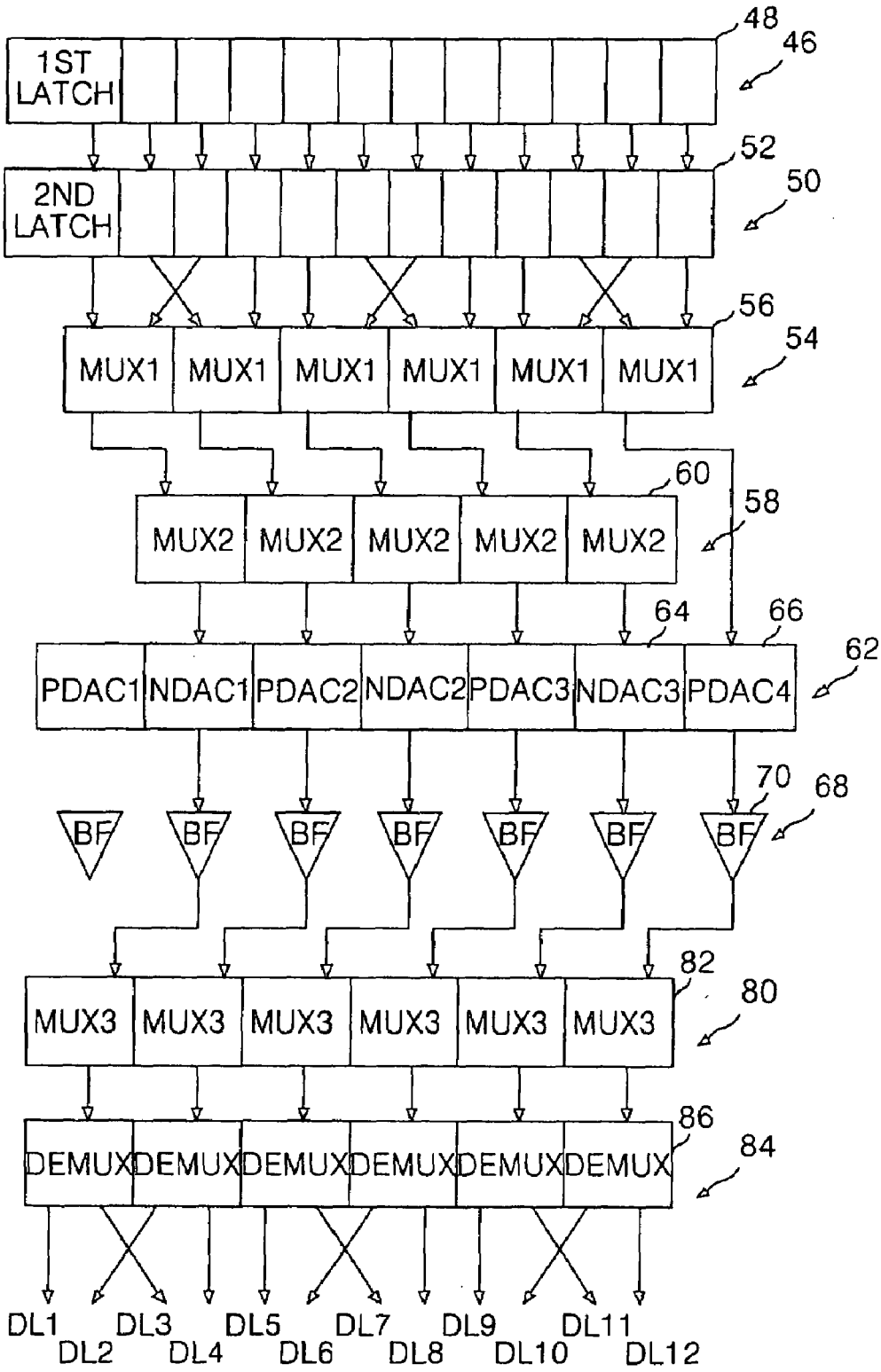
FIG. 7 is a flow chart representing a data flow within the data drive IC shown in FIG. 4 when a polarity control signal is in a high state.

FIGS. 6 and 7 are diagrams illustrating the proceeding path of the pixel data according to the polarity control signal (POL) within the data driving IC as shown in FIG. 4.

When the polarity control signal (POL) is in low state (or high state), the second MUX array 58, as shown in FIG. 6, supplies the pixel data of six numbers output from the first and second latch arrays 46 and 50 and the first MUX array 54 to each of the PDAC1 66 to NDAC3 64 except for the PDAC4 66, and converts the supplied pixel data into the pixel voltage signal. In this case, the output of the first MUX 56 of the first order is supplied intact to the PDAC1 66 and is converted into the pixel voltage signal. The third MUX array 80 causes the pixel voltage signals supplied from each of the PDAC1 66 to NDAC3 64 through the buffer array 68 to correspond one to one with the DEMUXs 86, thereby supplying the pixel voltage signals accordingly. Each of the DEMUX 86 selectively supplies the pixel voltage signal input from each of the third MUXs 82 to the data lines of 12 numbers (DL1 to DL12).

On the other hand, when the polarity control signal (POL) is in high state (or low state), the second MUX array 58, as shown in FIG. 7, causes the pixel data of six numbers output from the first and second latch arrays 46 and 50, and the first MUX array 54 to be shifted to the right, thereby supplying the shifted pixel data to each of the NDAC1 64 to PDAC3 66 except for the PDAC1 66 to convert the supplied pixel data into the pixel voltage signal. In this case, the output of the first MUX 56 of the last order is supplied intact to the PDAC4 66 to be converted into the pixel voltage signal. The third MUX array 82 causes the pixel voltage signals supplied from each of the NDAC1 64 to PDAC4 64 through the buffer array 68 to be shifted to the left to correspond one to one with the DEMUXs 86, thereby supplying the pixel voltage signal accordingly. Each of the DEMUXs 86 selectively supplies the pixel voltage signal input from each of the third MUXs 82 to the data lines of 12 numbers (DL1 to DL12).

As described above, the data drive IC according to the embodiment of the present invention can drive the data lines of 2n channels by use of the DACs of n+1 numbers because the DAC array is driven on a time-division basis. Alternatively, because each of the data drive IC comprising the DAC of n+1 numbers drives the data lines of 2n numbers, we can decrease the number of DAC ICs to half. Further, with respect to the embodiment of the present invention, because the one horizontal period (1H) is divided into four to supply the data during each of the odd-numbered divided-period and the even-numbered divided-period, the uniform pixel voltage signal can be charged to the liquid crystal cell.

Figure 8:
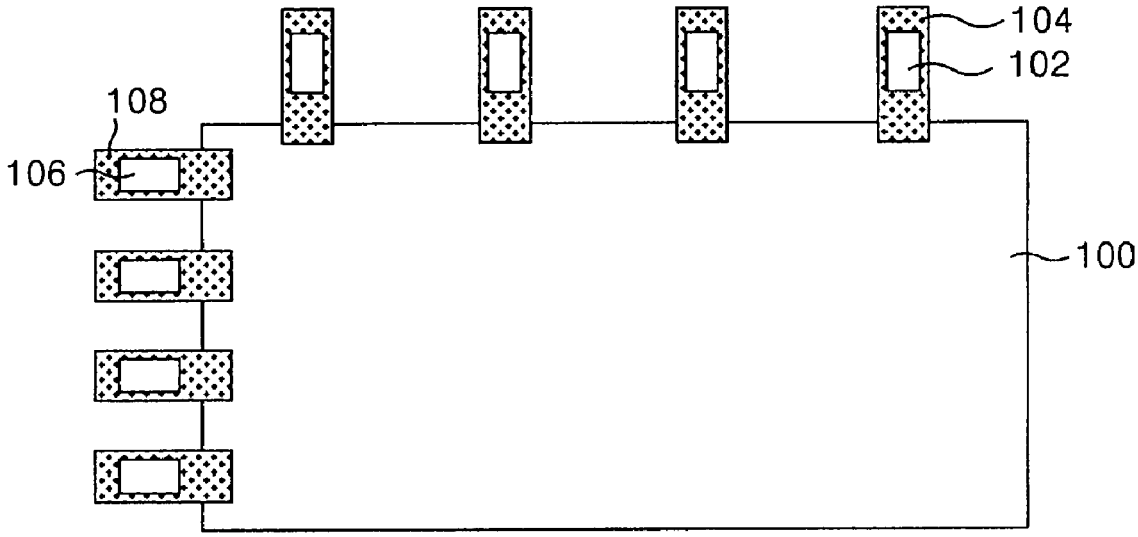
FIG. 8 is a schematic diagram illustrating a configuration of a liquid crystal display to which the data drive IC of FIG. 4 is applied.

FIG. 8 is a diagram schematically illustrating a configuration of the liquid crystal display to which the data drive IC of FIG. 4 is applied.

Referring to FIG. 8, the liquid crystal display comprises data drive ICs 102 connected to the liquid crystal display panel 100 through the data TCP 104, and gate drive ICs 106 connected to the liquid crystal display panel 100 through the gate TCP 108.

Each of the data drive ICs 102 is mounted on each of the data TCP 104, and is connected electrically to a data pad provided in the upper portion of the liquid crystal display panel 100 through the data TCP 104. Each of the gate drive ICs 106 is mounted to each of the gate TCP 108, and is connected electrically to the gate pad provided in the one side of the liquid crystal display panel through the gate TCP 108. The gate drive ICs 106 sequentially drive the gate lines on the liquid crystal display panel 100 one by one for each horizontal period (1H). The data drive ICs 102 convert the pixel data signal, which is a digital signal, into the pixel voltage signal, which is an analog signal, and perform time-division on the pixel voltage signal by the ¼ horizontal period (H/4), thereby supplying the time-divided signal to the data lines on the liquid crystal display panel 100. Hereby, to drive the data lines of 8 numbers, there are eight of data drive IC necessary in the prior art, but only four of the data drive ICs 102 are necessary in the present invention since the data lines of 2N numbers are driven on a time division basis.

Here, a difference between the charged amounts of pixel voltage of the liquid crystal cells can be minimized because the present invention divides the one horizontal period (1H) into four and supplies the pixel voltage in the odd-numbered period (the first and the third divided-period) and the even-numbered period (the second and the fourth period), respectively. Though the data drive IC is driven in such a manner, a little difference between the charged amounts of pixel voltage of the liquid crystal cells can probably be generated.

To prevent this, the difference between the charged amounts of pixel voltage can be compensated by way of changing the charge sequence of the pixel voltage for each specific unit such as line, field, frame, and so on. For example, in case that the pixel voltage is supplied to a specific liquid crystal cell during the odd-numbered divided-period of one horizontal period (1H) in the current frame to charge with the pixel voltage, the pixel voltage is supplied during the even-numbered divided-period in next frame. In this way, the difference between the charged amounts of pixel voltage, caused due to the difference of charging time, can be compensated by way of changing the pixel voltage charging sequence for each frame. Further, when the pixel voltage charging sequence is changed by the line or by the lines, the difference between the charged amounts of pixel voltage, caused due to the difference of charging time, can be compensated. Differently from this, in case that the pixel voltage charging sequence is changed by the line and frame or by the lines and frames, the difference between the charged amounts of pixel voltage can be compensated too.

Figure 9A:
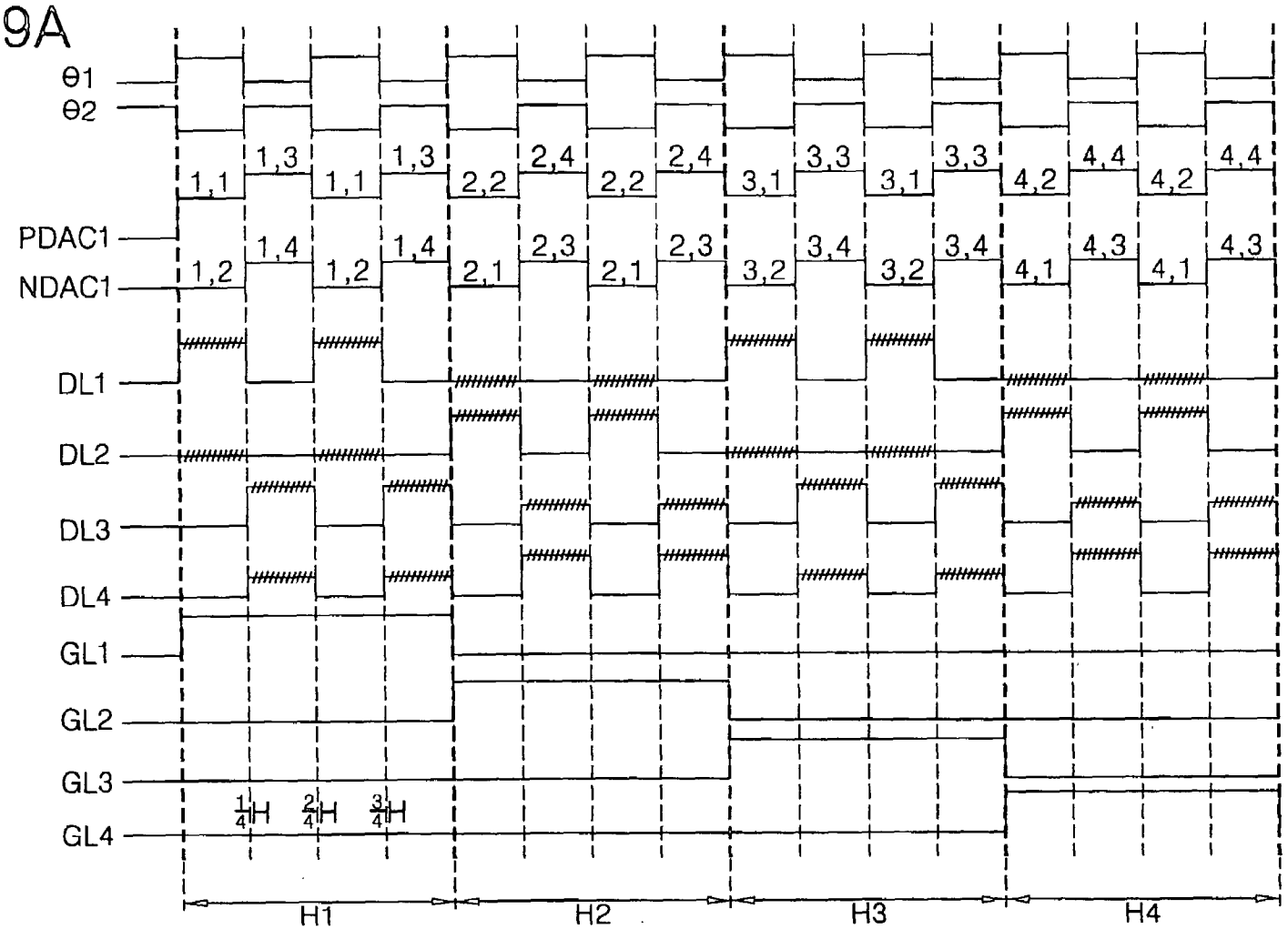
FIGS. 9A and 9B are waveform diagrams illustrating a signal waveform for driving data lines by changing a charging sequence for each frame when the data lines are driven on a time-division basis by a dot inversion system.
Figure 9B:
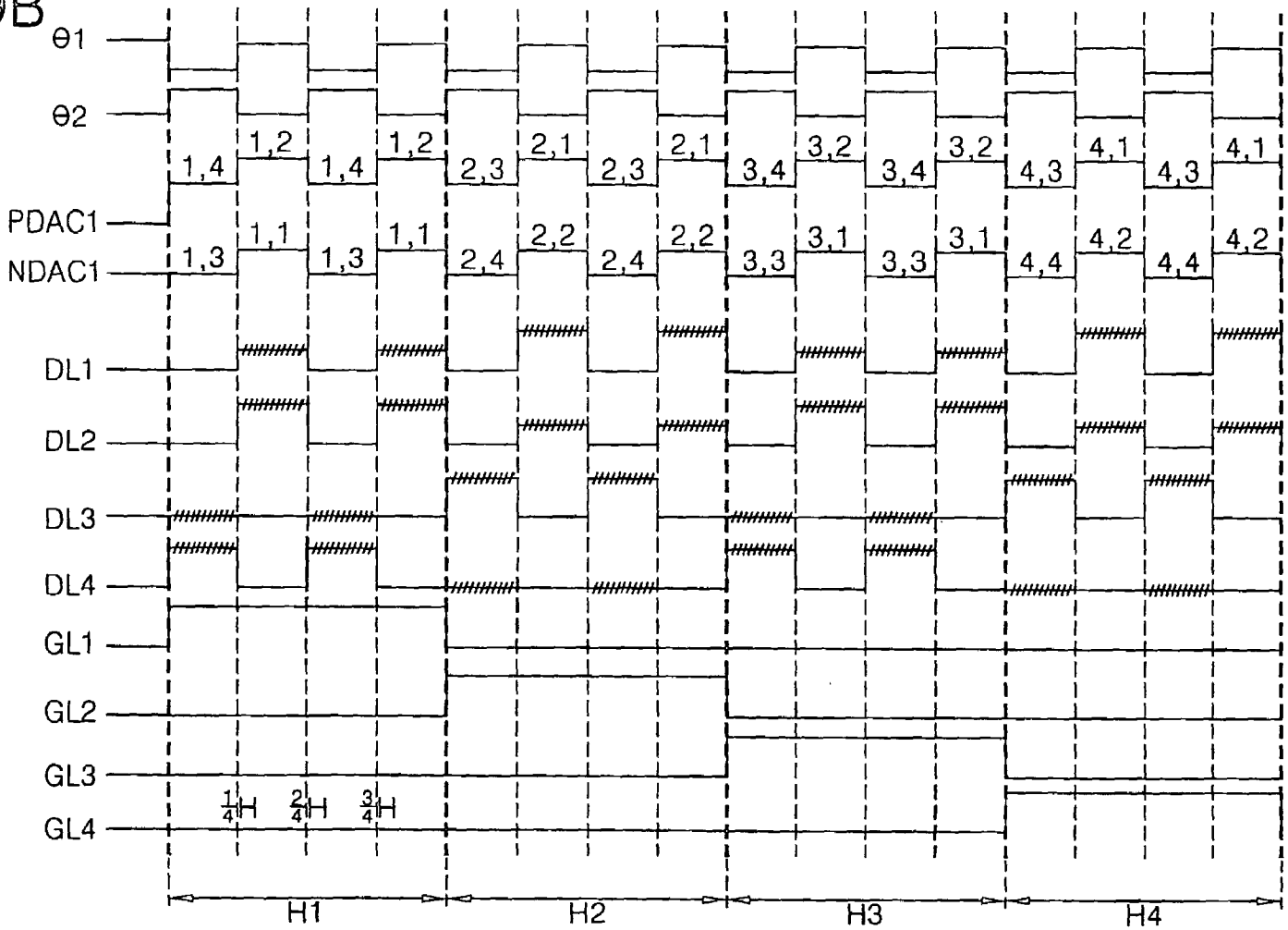

FIGS. 9A and 9A are waveform diagrams illustrating drive waveforms for driving data lines as changing the pixel voltage charging sequence for each frame when driving the data lines on a time-division basis. Herein, FIG. 9A is a signal waveform diagram in an odd-numbered frame, and FIG. 9B is a signal waveform diagram in an even-numbered frame.

With respect to FIG. 9A which corresponds to the odd-numbered frame, the pixel data [1,1],[1,2] are selected by the selection control signal (T1 and/or T2) in odd-numbered ¼ horizontal periods (the first ¼ horizontal period, the third ¼ horizontal period) of a first horizontal period (H1). The pixel data [1,1] is converted into the positive pixel voltage signal to be supplied to the first data line (DL1), and the pixel data [1,2] is converted into the negative pixel voltage signal to be supplied to the second data line (DL2).

Further, the pixel data [1,3],[1,4] are selected by the selection control signals (T1 and/or T2) in even-numbered ¼ horizontal periods (the second ¼ horizontal period, the fourth ¼ horizontal period). The pixel data [1,3] is converted into the positive pixel voltage signal to be supplied to the third data line (DL3), and the pixel data [1,4] is converted into the negative pixel voltage signal to be supplied to the fourth data line (DL4).

Similarly, the pixel data [2,1],[2,2] are selected by the selection control signal (T1 and/or T2) in odd-numbered ¼ horizontal periods (the first ¼ horizontal period, the third ¼ horizontal period) of a second horizontal period (H2). The pixel data [2,1] is converted into the negative pixel voltage signal to be supplied to the first data line (DL1), and the pixel data [2,2] is converted into the positive pixel voltage signal to be supplied to the second data line (DL2). Further, the pixel data [2,3],[2,4] are selected by the selection control signal (T1 and/or T2) in even-numbered ¼ horizontal periods (the second ¼ horizontal period, the fourth ¼ horizontal period). The pixel data [2,3] is converted into the negative pixel voltage signal to be supplied to the third data line (DL3), and the pixel data [2,4] is converted into the positive pixel voltage signal to be supplied to the fourth data line (DL4).

The data-driving apparatus of the present invention drives the data lines on a time-division basis and, in addition, by a dot inversion system, in the odd-numbered frame.

With respect to the FIG. 9B corresponding to the even-numbered frame, the pixel data [1,3],[1,4] are selected, differently from the odd-numbered frame, by the selection control signal (T1 and/or T2) in odd-numbered ¼ horizontal periods (the first ¼ horizontal period, the third ¼ horizontal period) of the first horizontal period (H1). The pixel data [1,3] is converted into the negative pixel voltage signal to be supplied to the third data line (DL3), and the pixel data [1,4] is converted into the positive pixel voltage signal to be supplied to the fourth data line (DL4).

Further, the pixel data [1,1],[1,2] are selected by the selection control signal (T1 and/or T2) in even-numbered ¼ horizontal periods (the second ¼ horizontal period, the fourth ¼ horizontal period). The pixel data [1,1] is converted into the negative pixel voltage signal to be supplied to the first data line (DL1), and the pixel data [1,2] is converted into the positive pixel voltage signal to be supplied to the fourth data line (DL4).

Similarly, the pixel data [2,3],[2,4] are selected by the selection control signal (T1 and/or T2) in odd-numbered ¼ horizontal period (the first ¼ horizontal period, the third ¼ horizontal period) as dividing in four the second horizontal period (H2). The pixel data [2,3] is converted into the positive pixel voltage signal and is supplied to the third data line (DL3), and the pixel data [2,4] is converted into the negative pixel voltage signal and is supplied to the fourth data line (DL4).

Further, the pixel data [2,1],[2,2] are selected by the selection control signal (T1 and/or T2) in even-numbered ¼ horizontal periods (the second ¼ horizontal period, the fourth ¼ horizontal period). The pixel data [2,1] is converted into the positive pixel voltage signal to be supplied to the first data line (DL1), and the pixel data [2,2] is converted into the negative pixel voltage signal to be supplied to the second data line (DL2).

The data-driving apparatus of the present invention drives the data lines on a time-division basis and, in addition, by a dot inversion system, in the even-numbered frame. In addition, the data driving apparatus of the present invention is driven with the pixel voltage charging sequence changed in the odd-numbered frame and in odd-numbered frame. Hereby, this invention can compensate the difference between the charged amounts of pixel voltage generated in the odd-numbered frame or even-numbered frame due to the difference of charging time according to the drive on the time-division basis, in even-numbered frame or odd-numbered frame. As a result, this invention can prevent flicker caused by the difference between the charged amounts of pixel voltage when driving the data lines on the time-division basis. The present invention inverts the polarity of the selection control signal (T1 and/or T2) for each frame to change the pixel voltage charging sequence between the odd-numbered frame and the even-numbered frame.

Figure 10A:
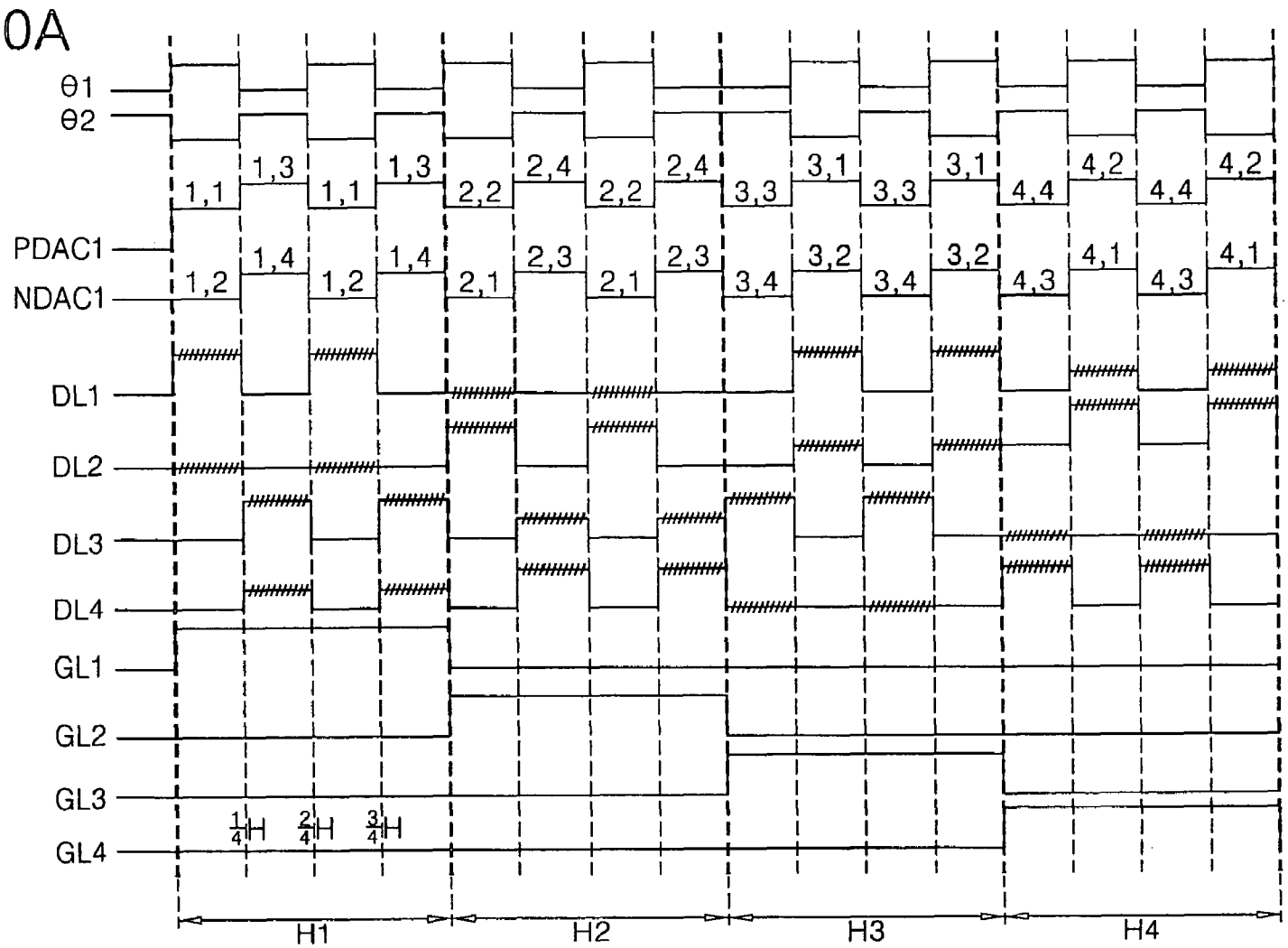
FIGS. 10A and 10B are waveform diagrams illustrating a signal waveform for driving data lines by changing a charging sequence for each frame and for each second line when the data lines are driven on a time-division basis by a dot inversion system.
Figure 10B:
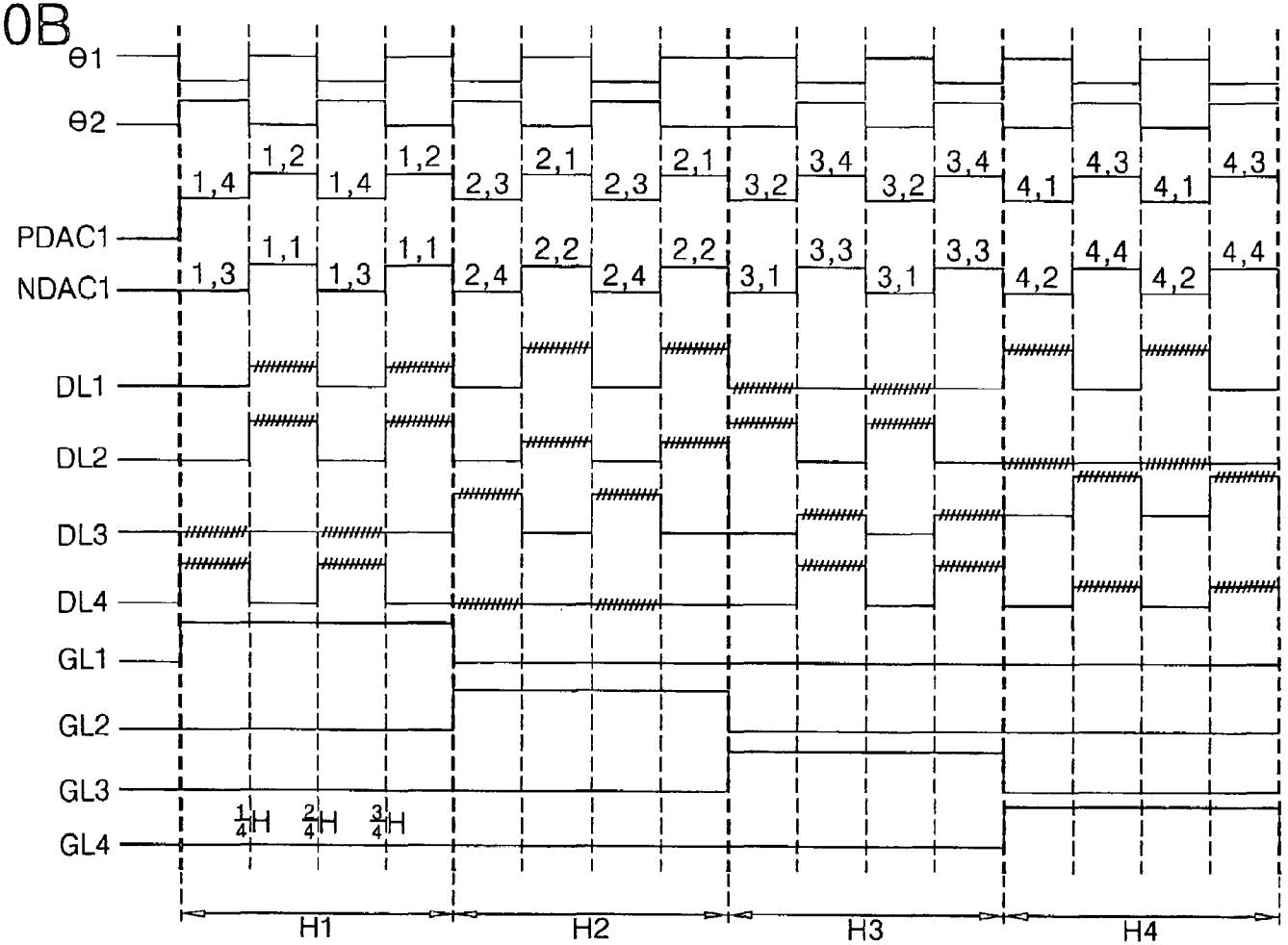

FIGS. 10A and 10B are waveform diagrams illustrating drive waveforms for driving data lines as changing the pixel voltage charging sequence for each second line and for each frame when driving the data lines on a time-division basis. Herein, FIG. 10A is a signal waveform diagram in an odd-numbered frame, and FIG. 10B is a signal waveform diagram in an even-numbered frame.

With respect to the FIG. 10A corresponding to the odd-numbered frame, the pixel data [1,1],[1,2] are selected by the selection control signal (T1 and/or T2) in odd-numbered ¼ horizontal periods (the first ¼ horizontal period, the third ¼ horizontal period) of the first horizontal period (H1). The pixel data [1,1] is converted into the positive pixel voltage signal to be supplied to the first data line (DL1), and the pixel data [1,2] is converted into the negative pixel voltage signal to be supplied to the second data line (DL2).

Further, the pixel data [1,3],[1,4] are selected by the selection control signal (T1 and/or T2) in even-numbered ¼ horizontal periods (the second ¼ horizontal period, the fourth ¼ horizontal period). The pixel data [1,3] is converted into the positive pixel voltage signal to be supplied to the third data line (DL3), and the pixel data [1,4] is converted into the negative pixel voltage signal to be supplied to the fourth data line (DL4).

Similarly, the pixel data [2,1],[2,2] are selected by the selection control signal (T1 and/or T2) in odd-numbered ¼ horizontal periods (the first ¼ horizontal period, the third ¼ horizontal period) of the second horizontal period (H2). The pixel data [2,1] is converted into the negative pixel voltage signal to be supplied to the first data line (DL1), and the pixel data is converted into the positive pixel voltage signal to be supplied to the second data line (DL2).

Further, the pixel data [2,3],[2,4] are selected by the selection control signal (T1 and/or T2) in even-numbered ¼ horizontal periods (the second ¼ horizontal period, the fourth ¼ horizontal period). The pixel data [2,3] is converted into the negative pixel voltage signal to be supplied to the third data line (DL3), and the pixel data [2,4] is converted into the positive pixel voltage signal to be supplied to the fourth data line (DL4).

On the other hand, the pixel data [3,3],[3,4] are selected, differently from the first horizontal period (H1), in odd-numbered ¼ horizontal periods (the first ¼ horizontal period, the third ¼ horizontal period) of the third horizontal period (H3). The pixel data [3,3] is converted into the positive pixel voltage signal to be supplied to the third data line (DL3), and the pixel data [3,4] is converted into the negative pixel voltage signal to be supplied to the fourth data line (DL4).

Further, the pixel data [3,1],[3,2] are selected in even-numbered ¼ horizontal periods (the second ¼ horizontal period, the fourth ¼ horizontal period). The pixel data [3,1] is converted into the positive pixel voltage signal to be supplied to the first data line (DL1), and the pixel data [3,2] is converted into the negative pixel voltage signal to be supplied to the second data line (DL2).

Also, the pixel data [4,3],[4,4] are selected, differently from said second horizontal period (H2), in odd-numbered ¼ horizontal periods (the first ¼ horizontal period, the third ¼ horizontal period) of the fourth horizontal period (H4). The pixel data [4,3] is converted into the negative pixel voltage signal to be supplied to the third data line (DL3), and the pixel data [4,4] is converted into the positive pixel voltage signal to be supplied to the fourth data line (DL4).

Further, the pixel data [4,1],[4,2] are selected in even-numbered ¼ horizontal periods (the second ¼ horizontal period, the fourth ¼ horizontal period). The pixel data [3,1] is converted into the negative pixel voltage signal to be supplied to the first data line (DL1), and the pixel data [4,2] is converted into the positive pixel voltage signal to be supplied to the second data line (DL2).

The data-driving apparatus of the present invention drives the data lines on a time-division basis and, in addition, by a dot inversion system. The present invention drives by changing the pixel voltage charging sequence for each second line. Here, the polarity of the selection control signal (T1 and/or T2) of the present invention is inverted for each second line.

With respect to the FIG. 10A corresponding to the even-numbered frame, the pixel data [1,3],[1,4] are selected, differently from odd-numbered frame, by the selection control signal (T1 and/or T2) in odd-numbered ¼ horizontal periods (the first ¼ horizontal period, the third ¼ horizontal period) of the first horizontal period (H1). The pixel data [1,3] is converted into the negative pixel voltage signal to be supplied to the third data line (DL3), and the pixel data [1,4] is converted into the positive pixel voltage signal to be supplied to the fourth data line (DL4).

Further, the pixel data [1,1],[1,2] are selected by the selection control signal (T1 and/or T2) in even-numbered ¼ horizontal periods (the second ¼ horizontal period, the fourth ¼ horizontal period). The pixel data [1,1] is converted into the negative pixel voltage signal to be supplied to the first data line (DL1), and the pixel data [1,2] is converted into the positive pixel voltage signal to be supplied to the fourth data line (DL4).

Similarly, the pixel data [2,3],[2,4] are selected by the selection control signal (T1 and/or T2) in odd-numbered ¼ horizontal periods (the first ¼ horizontal period, the third ¼ horizontal period) of the second horizontal period (H2). The pixel data [2,3] is converted into the positive pixel voltage signal to be supplied to the third data line (DL3), and the pixel data [2,4] is converted into the negative pixel voltage signal to be supplied to the fourth data line (DL4).

Further, the pixel data [2,1],[2,2] are selected by the selection control signal (T1 and/or T2) in even-numbered ¼ horizontal periods (the second ¼ horizontal period, the fourth ¼ horizontal period). The pixel data [2,1] is converted into the positive pixel voltage signal to be supplied to the first data line (DL1), and the pixel data [2,2] is converted into the negative pixel voltage signal to be supplied to the second data line (DL2).

On the other hand, the pixel data [3,1],[3,2] are selected, differently from said first horizontal period (H1), in odd-numbered ¼ horizontal periods (the first ¼ horizontal period, the third ¼ horizontal period) of the third horizontal period (H3). The pixel data [3,1] is converted into the negative pixel voltage signal to be supplied to the first data line (DL1), and the pixel data [3,2] is converted into the positive pixel voltage signal to be supplied to the second data line (DL2).

Further, the pixel data [3,3],[3,4] are selected in even-numbered ¼ horizontal periods (the second ¼ horizontal period, the fourth ¼ horizontal period). The pixel data [3,3] is converted into the negative pixel voltage signal to be supplied to the third data line (DL3), and the pixel data [3,4] is converted into the positive pixel voltage signal to be supplied to the fourth data line (DL4).

Moreover, the pixel data [4,1],[4,2] are selected, differently from said second horizontal period (H2), in odd-numbered ¼ horizontal periods (the first ¼ horizontal period, the third ¼ horizontal period) of the fourth horizontal period (H4). The pixel data [4,1] is converted into the positive pixel voltage signal to be supplied to the first data line (DL1), and the pixel data [4,2] is converted into the negative pixel voltage signal to be supplied to the second data line (DL2).

Further, the pixel data [4,3],[4,4] are selected in even-numbered ¼ horizontal periods (the second ¼ horizontal period, the fourth ¼ horizontal period). The pixel data [4,3] is converted into the positive pixel voltage signal to be supplied to the third data line (DL3), and the pixel data [4,4] is converted into the negative pixel voltage signal to be supplied to the fourth data line (DL4).

The data-driving apparatus of the present invention drives the data lines on a time-division basis and, in addition, by a dot inversion system, in the even-numbered frame. Further, the data driving apparatus of the present invention is driven with the pixel voltage charging sequence changed for each second line and for each frame. Hereby, this invention can compensate the difference between the charged amounts of pixel voltage generated due to the difference of charging time according to the drive on the time-division basis. On the other hand, the polarity of the selection control signal (T1 and/or T2) of the present invention is inverted for each second line and for each frame.

Differently from this, even when changing the pixel voltage charging sequence by the line or by the lines (for example, for each fourth line) and, in addition, changing the pixel voltage charging sequence for each frame, the present invention can compensate the difference between the charged amounts of pixel voltage. As a result, when time-division-driving the data lines, the present invention can prevent the flicker phenomenon due to the difference between the charged amounts of pixel voltage.

As described above, the data driving apparatus and the method of the liquid crystal display according to the present invention can drive the data lines of at least 2n numbers by use of the DAC of n+1 numbers by means of driving the DAC part on the time-division basis. Hereby, the data driving apparatus and the method of the liquid crystal display according to the present invention can reduce the number of the data drive ICs in half as compared with the related art, thereby reducing fabrication cost.

Further, because the data driving apparatus and the method of the liquid crystal display according to the present invention supplies the data wile having one horizontal period divided into four ¼ periods, the difference of charging quantity between liquid crystal cells can be minimized. In addition, the data driving apparatus and the method of the liquid crystal display according to the present invention is driven on the time-division basis as changing the pixel voltage charging sequence by the line, by the lines, by the frame, by the line and frame, or by the lines and frames. Hereby, the flicker phenomenon can be prevented by compensating the difference between the charged amounts of pixel voltage generated due to the difference of the charging time according to the drive on the time division basis.

It will be apparent to those skilled in the art that various modifications and variations can be made in the method and apparatus for driving a liquid crystal display of the present invention without departing from the spirit or scope of the invention. Thus, it is intended that the present invention cover the modifications and variations of this invention provided they come within the scope of the appended claims and their equivalents.

What is claimed is:

1. A driving apparatus for a liquid crystal display, comprising:

a first multiplexor array to perform time-division on input pixel data to supply time-divided pixel data having a horizontal period divided into four ¼ periods;

a digital-analog conversion array to convert the time-divided pixel data pixel into voltage signals; and a demultiplexor array to drive data lines by performing time-division on the pixel voltage signal by the ¼ periods wherein the first multiplexor array includes at least N (N being a positive integer) of multiplexors and performs time-division on a plurality of input pixel data to supply the time-divided pixel data, wherein the digital-analog conversion array converts the time-divided pixel data into the pixel voltage signals, and wherein the demultiplexor array includes at least N of demultiplexors and supplies the pixel voltage signals into a plurality of data lines;

wherein the digital-analog conversion array includes at least N+1 positive and negative digital-analog converters to convert the time-divided pixel data into the pixel voltage signals, the positive and negative digital-analog converters being alternately arranged.

2. The driving apparatus according to claim 1, further comprising:

a shift register array to sequentially generate a sampling signal;

a latch array to sequentially latch the pixel data by designated units in response to the sampling signal such that the latched data is simultaneously output to the first multiplexor array; and a buffer array to buffer the pixel voltage signal and to supply the buffered pixel voltage signal to the demultiplexor array.

3. The driving apparatus according to claim 1, further comprising:

a second multiplexor array to determine a proceeding path of the time-divided pixel data in response to an input polarity control signal to supply the time-divided pixel data to at least N of the positive and negative digital-analog converters among the at least N+1 positive and negative digital-analog converters; and a third multiplexor array to determine a proceeding path of the pixel voltage signal in response to the polarity control signal to supply the pixel voltage signal to the demultiplexor array.

4. The driving apparatus according to claim 3, wherein the second multiplexor array includes at least N−1 second multiplexors to select any one of the outputs of at least two of the first multiplexors, wherein the third multiplexor array includes at least N third multiplexors to select any one of the outputs of at least two of the digital-analog converters, and wherein the output of each of the first multiplexors is commonly input to at least two of the second multiplexors, and wherein the output of each of the digital-analog converters is commonly input to at least two of the third multiplexors.

5. The driving apparatus according to claim 1, wherein among the at least N first multiplexors, an odd-numbered multiplexor performs time-division on odd-numbered pixel data in response to an input first selection control signal, and an even-numbered multiplexor performs time-division on even-numbered pixel data in response to an input second selection control signal, thereby outputting the time-divided pixel data.

6. The driving apparatus according to claim 5, wherein among the at least N demultiplexors, an odd-numbered demultiplexor drives odd-numbered data lines on a time-division basis in response to the first selection control signal, and an even-numbered demultiplexor drives even-numbered data lines on a time-division basis in response to the second selection control signal.

7. The driving apparatus according to claim 6, wherein the first and second selection control signals have a logic state contrary to each other and the logic state is inverted at least for each ¼ horizontal period.

8. The driving apparatus according to claim 7, wherein the first multiplexor array and the demultiplexor array supply the time-divided pixel data and pixel voltage signal as alternately changing supply sequences of the time-divided pixel data and pixel voltage signals for each specific unit in response to the first and second selection control signals.

9. The driving apparatus according to claim 8, wherein the first multiplexor array and the demultiplexor array change supply sequences of the time-divided pixel data and pixel voltage signals for each frame in response to the first and second selection control signals.

10. The driving apparatus according to claim 9, wherein polarities of the first and second selection control signals are inverted for each frame.

11. The driving apparatus according to claim 8, wherein the first multiplexor array and the demultiplexor array change supply sequences of the time-divided pixel data and pixel voltage signals at least for each line in response to the first and second selection control signals.

12. The driving apparatus according to claim 11, wherein polarities of the first and second selection control signals are inverted at least for each line.

13. The driving apparatus according to claim 8, wherein the first multiplexor array and the demultiplexor array change supply sequences of the time-divided pixel data and pixel voltage signals for each second line and for each frame in response to the first and second selection control signals.

14. The driving apparatus according to claim 13, wherein polarities of the first and second selection control signals are inverted for each second line and for each frame.

15. The driving apparatus according to claim 8, wherein the first multiplexor array and the demultiplexor array change supply sequences of the time-divided pixel data and pixel voltage signals at least for each line and for each frame in response to the first and second selection control signals.

16. A driving apparatus for a liquid crystal display, comprising:

a first multiplexor array to perform time-division on input pixel data to supply time-divided pixel data having a horizontal period divided into four ¼ periods;

a digital-analog conversion array to convert the time-divided pixel data pixel voltage signals; and a demultiplexor array to drive data lines by performing time-division on the pixel voltage signal by the ¼ period, wherein the same data is supplied to any one of the data lines during first and third ones of the ¼ periods of the horizontal period.

17. A driving apparatus for a liquid crystal display, comprising:

a first multiplexor array to perform time-division on input pixel data to supply time-divided pixel data having a horizontal period divided into four ¼ periods;

a digital-analog conversion array to convert the time-divided pixel data pixel voltage signals; and a demultiplexor array to drive data lines by performing time-division on the pixel voltage signal by the ¼ period, wherein the same data is supplied to any one of the data lines during second and fourth ones of the ¼ periods of the horizontal period.

18. A driving method of a liquid crystal display, comprising the steps of:

performing time-division on input pixel data to supply time-divided pixel data having a horizontal period divided into four ¼ periods by a first multiplexor array;

converting the time-divided pixel data into pixel voltage signals by a digital-analog conversion array; and performing time-division on the pixel voltage signal to supply the time-divided pixel voltage signal to data lines of the liquid crystal display by the ¼ period by a demultiplexor array;

wherein the first multiplexor array includes at least N (N being a positive integer) of multiplexors and performs time-division on a plurality of input pixel data to supply the time-divided pixel data, wherein the digital-analog conversion array converts the time-divided pixel data into the pixel voltage signals, and wherein the demultiplexor array includes at least N of demultiplexors and supplies the pixel voltage signals into a plurality of data lines;

wherein the digital-analog conversion array includes at least N+1 positive and negative digital-analog converters to convert the time-divided pixel data into the pixel voltage signals, the positive and negative digital-analog converters being alternately arranged.

19. The driving method according to claim 18, wherein, in the step of converting the time-divided pixel data into pixel voltage signals, each of the pixel data is converted into the pixel voltage signal with a polarity different from adjacent pixel data.

20. The driving method according to claim 18, wherein a supply sequence of the time-divided pixel data is alternately changed for each specific unit in the step of performing time-division on the pixel data; and a supply sequence of the pixel voltage signals is alternately changed for each specific unit in the step of driving the data lines on the time-division basis.

21. The driving method according to claim 20, wherein the supply sequences of the time-divided pixel data and pixel voltage signals are alternately changed for each frame.

22. The driving method according to claim 20, wherein the supply sequences of the time-divided pixel data and pixel voltage signals are changed at least for each line.

23. The driving method according to claim 20, wherein the supply sequence of the time-divided pixel data and the pixel voltage signals are changed at least for each line and for each frame.

24. A driving method of a liquid crystal display, comprising the steps of:

performing time-division on input pixel data to supply time-divided pixel data having a horizontal period divided into four ¼ periods;

converting the time-divided pixel data into pixel voltage signals; and performing time-division on the pixel voltage signal to supply the time-divided pixel voltage signal to data lines of the liquid crystal display by the period;

wherein, the same data is supplied to any one of the data lines during first and third ones of the ¼ periods of the horizontal period.

25. A driving method of a liquid crystal display, comprising the steps of:

performing time-division on input pixel data to supply time-divided pixel data having a horizontal period divided into four ¼ periods;

converting the time-divided pixel data into pixel voltage signals; and performing time-division on the pixel voltage signal to supply the time-divided pixel voltage signal to data lines of the liquid time-divided pixel voltage signal to data lines of the liquid crystal display by the ¼ period;

wherein the same data is supplied to any one of the data lines during second and fourth ones of the ¼ period.

26. A liquid crystal display, comprising:

a liquid crystal panel; and a driving apparatus connected to the liquid crystal panel, the driving apparatus including:

a first multiplexor array to perform time-division on input pixel data to supply time-divided pixel data having a horizontal period divided into four ¼ periods;

a digital-analog conversion array to convert the time-divided pixel data pixel voltage signals; and a demultiplexor array to drive data lines by performing time-division on the pixel voltage signal by the ¼ period;

wherein the first multiplexor array includes at least N (N being a positive integer) of multiplexors and performs time-division on a plurality of input pixel data to supply the time-divided pixel data, wherein the digital-analog conversion array converts the time-divided pixel data into the pixel voltage signals, and wherein the demultiplexor array includes at least N of demultiplexors and supplies the pixel voltage signals into a plurality of data lines;

wherein the digital-analog conversion array includes at least N+1 positive and negative digital-analog converters to convert the time-divided pixel data into the pixel voltage signals, the positive and negative digital-analog converters being alternately arranged.

27. A driving apparatus for a liquid crystal display, comprising:

first means for performing time-division on input pixel data to supply time-divided pixel data having a horizontal period divided into four ¼ periods;

second means for converting the time-divided pixel data into pixel voltage signals; and third means for performing time-division on the pixel voltage signal to supply the time-divided pixel voltage signal to data lines of the liquid crystal display by the ¼ period;

wherein the first multiplexor array includes at least N (N being a positive integer) of multiplexors and performs time-division on a plurality of input pixel data to supply the time-divided pixel data, wherein the digital-analog conversion array converts the time-divided pixel data into the pixel voltage signals, and wherein the demultiplexor array includes at least N of demultiplexors and supplies the pixel voltage signals into a plurality of data lines;

wherein the digital-analog conversion array includes at least N+1 positive and negative digital-analog converters to convert the time-divided pixel data into the pixel voltage signals, the positive and negative digital-analog converters being alternately arranged.

28. A liquid crystal display, comprising:

a liquid crystal panel; and a driving apparatus connected to the liquid crystal panel, the driving apparatus including:

a first multiplexor array to perform time-division on input pixel data to supply time-divided pixel data having a horizontal period divided into four ¼ periods;

a digital-analog conversion array to convert the time-divided pixel data pixel voltage signals; and a demultiplexor array to drive data lines by performing time-division on the pixel voltage signal by the ¼ period;

wherein the same data is supplied to any one of the data lines during first and third ones of the ¼ periods of the horizontal period, or during second and fourth ones of the ¼ periods of the horizontal period.

* * * * *